US009105140B2

(12) United States Patent
Enomoto

(10) Patent No.: US 9,105,140 B2
(45) Date of Patent: Aug. 11, 2015

(54) COIN HOPPER

(71) Applicant: ASAHI SEIKO CO., LTD., Tokyo (JP)

(72) Inventor: Minoru Enomoto, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 0 days.

(21) Appl. No.: 14/100,439

(22) Filed: Dec. 9, 2013

(65) Prior Publication Data

US 2014/0170948 A1 Jun. 19, 2014

(30) Foreign Application Priority Data

Dec. 18, 2012 (JP) ..... 2012-275318

(51) Int. Cl.

| | |
|---|---|
| ***G07D 3/00*** | (2006.01) |
| ***G07D 3/06*** | (2006.01) |
| ***G07D 3/12*** | (2006.01) |
| ***G07D 9/00*** | (2006.01) |

(52) U.S. Cl.

CPC .. *G07D 3/00* (2013.01); *G07D 3/06* (2013.01); *G07D 3/128* (2013.01); *G07D 9/008* (2013.01)

(58) Field of Classification Search

CPC ..... G07D 3/128; G07D 9/008; G07D 3/16; G07D 3/02; G07D 3/06; G07D 3/00; G07D 3/10; G07D 9/065; G07D 3/04; G07D 9/00; G07D 1/00; G07D 9/04; G07D 3/14; G07F 1/047; A45C 1/02; G06M 7/04

USPC ..... 453/6, 10, 12, 13, 33, 34, 35, 49, 57

See application file for complete search history.

(56) References Cited

U.S. PATENT DOCUMENTS

| | | | | |
|---|---|---|---|---|
| 6,273,809 | B1 * | 8/2001 | Bell et al. | 453/57 |
| 2003/0024791 | A1 * | 2/2003 | Kurosawa et al. | 194/302 |
| 2006/0113161 | A1 * | 6/2006 | Umeda | 194/302 |
| 2009/0029638 | A1 * | 1/2009 | Enomoto | 453/57 |

FOREIGN PATENT DOCUMENTS

| | | |
|---|---|---|
| EP | 0957456 | 11/1999 |
| EP | 1624418 | 2/2006 |
| EP | 1734485 | 12/2006 |
| EP | 1918888 | 5/2008 |
| JP | 2008-097322 | 4/2008 |
| JP | 4343199 | 7/2009 |
| JP | 4784806 | 7/2011 |

OTHER PUBLICATIONS

Search report from E.P.O., mail date is Mar. 28, 2014.

* cited by examiner

*Primary Examiner* — Jeffrey Shapiro
(74) *Attorney, Agent, or Firm* — Greenblum & Bernstein, P.L.C.

(57) ABSTRACT

Coins in a storing chamber are stirred and dropped into through holes by the rotation of a sorting board, become a surface contact state on a coin holding plate, and are held in coin holding space. The coin in the coin holding space is rotated together with the rotation of the sorting board. At a specified phase, the coin is pushed out to a circumferential-direction passage, which is continued to the coin holding space and extending in the circumferential direction of the sorting board, by a pusher, which moves to the coin holding space. The coin is pushed against a coin receiver, which is arranged to be adjacent to the sorting board, by a pusher constituting an end part of the circumferential-direction passage. In this state, pushing is switched to that by a rotating pushing piece, and the coin is finally fed out by the pushing piece.

10 Claims, 20 Drawing Sheets

COIN HOPPER

BACKGROUND OF THE INVENTION

1. Field of the Invention

The present invention relates to a coin hopper that sorts and feeds coins one by one, which coins are stored in bulk in a storing chamber.

Particularly, the present invention relates to the coin hopper that sorts and feeds coins one by one which have different diameters and are stored in bulk in a storing chamber.

More particularly, the present invention relates to the coin hopper that can precisely separate and feed the coins one by one which have diameters of 20 millimeters to 26 millimeters.

More particularly, the present invention relates to the coin hopper that can convey coins having different diameters in a specified direction after sorting and feeding the coins one by one.

The coins include coins serving as current money, medals and tokens of game machines, and the like.

2. Description of Related Art

As a first conventional technique, a coin hopper is known that can sort and dispense coins one by one which are stored in bulk in a storing chamber of a storing bowl and have different diameters; wherein, a circular supporting rack that protrudes at the center of the rotating disk is arranged on an upper surface of an upwardly inclined rotating disk, coin stoppers are arranged radially from the supporting rack side so as to freely advance to and retreat from the surface of the rotating disk, a coin receiving knife is arranged at a specified position, a coin supported by the supporting rack and pushed by the coin stoppers is received in the circumferential direction of the rotating disk by the receiving knife, and, after the coin is received, the coin stoppers are pushed into the rotating disk by the receiving knife to cause the receiving knife to retreat (see Patent Document 1).

As a second conventional technique, there is known a coin hopper according to an application of the present applicant comprised of: coin stoppers that are upwardly inclined at a specified angle, have a circular supporting rack formed at the center of the upper surface thereof, and expand radially at regular intervals in a circumferential direction from the supporting rack side; a rotating disk that causes the surfaces of the coins to contact a holding surface between the coin stoppers, receives the coins one by one, supports them by the supporting rack, and feeds them out; an outer cover that surrounds at least the lower outer circumference of the rotating disk; a storing bowl that stores coins in bulk after the outer cover; and a coin receiving device that expands from the vicinity of the supporting rack to the circumferential direction of the rotating disk; wherein the coin stoppers are arranged in a state fixed to the rotating disk, and the coin receiving device is arranged so as to be able to contact and get away from the holding surface of the rotating disk (see Patent Document 2).

As a third conventional technique, there is known a coin hopper, wherein part of a coin housing hopper surrounding a bored disk rotor is cut out to form a coin lead-out opening from a coin conveying path implemented by the rotation of the rotor, the width of an opening with which a coin dispensing roller facing the upstream side thereof and a separate roller facing the downstream side thereof are opposed to each other is kept narrower than the diameter of a minimum coin, while the width of an opening with which an upstream-side opening edge of the coin lead-out opening and the separate roller are opposed to each other is kept wider than the diameter of a maximum coin, coins are smoothly dispensed when the rotor is rotated forward at the upstream-side opening edge of the coin lead-out opening, and a coin guiding wall surface that collects and returns coins to the coin conveying path when the rotor is rotated backward is formed (see Patent Document 3).

As a fourth conventional technique, there is known a coin delivery device of a coin processing apparatus according to an application of the present applicant, which holds coins in sorting concave parts arranged in an upper surface of a rotating disk and sorts the coins one by one and then transfers the coins to a coin carrier; wherein the sorting concave parts of the rotating disk are open in the upper surface side of the rotating disk, have fan shapes open to the circumferential surface side of the rotating disk, have coin pushing parts at parts thereof, and are provided with moving bodies that form part of the sorting concave parts and are capable of moving in the diameter direction of the rotating disk; the moving body is positioned in the side of the coin pushing part when the coin is received and is moved to the circumferential opening side when the coin is transferred to the coin carrier (see Patent Document 4).

[Patent Document 1] European Patent Application Publication No. 0957456 (FIG. 1 to FIG. 7 and page 2 to page 4)

[Patent Document 2] Japanese Unexamined Patent Application Publication No. 2008-97322 (FIG. 1 to FIG. 10 and Paragraph Numbers 0088 to 0029)

[Patent Document 3] Japanese Patent No. 4343199 (FIG. 3 to FIG. 33 and Paragraph Numbers 0001 to 0090)

[Patent Document 4] Japanese Patent No. 4784806 (FIGS. 1 to 5, Paragraph Numbers 0018 to 0053)

In the first conventional technique, the coin stoppers of for example eight plate-like bodies are arranged radially at regular intervals and are elastically biased so as to protrude from the surface of the rotating disk, and, after the coin stoppers transfer coins to the receiving knife, the coin stoppers are pushed into the rotating disk by the receiving knife and retreated.

This coin hopper can dispense coins held between the coin stoppers and therefore has an advantage that it can dispense coins of diameters in a specified range.

However, there is a problem that downsizing is limited since the receiving knife is arranged outside of an outer edge of the rotating disk.

As well as the first conventional technique, the second conventional technique includes the rotating disk, the coin stoppers, and the receiving knife. Since the receiving knife is opposed to the upper surface of the rotating disk, it can be more downsized than the first conventional technique. However, the angle of the rotating disk has to be inclined to nearly a vertical state so that the coins do not reach the receiving knife unit, and a storing unit of coins has to be arranged in front of the rotating disk. If the storage amount of the coins is increased, the diameter of the rotating disk has to be increased and/or the storing chamber of the coins has to be expanded to the front of the rotating disk, and there is a problem that downsizing is limited.

In the third conventional technique, a disk-rotor main body (rotating disk) having circular coin receiving holes (through holes) is horizontally arranged at a bottom hole of a body tube (storing bowl), coins are dropped and sorted one by one into the through holes by the rotation of the rotating disk, the coins are guided in the circumferential direction by coin receiving/stopping pins while the sorted coins are pushed by rear curved wings (pushing pieces) formed on a lower surface of the rotating disk, and the coins are pushed into the part between the coin separate roller and the coin dispensing roller and flicked by the coin dispensing roller; therefore, this is more suitable for downsizing than the first and second conventional techniques. However, the positions of the coin receiving/stopping pins (regulating pins) are common to the coins of all diameters. There are optimum positions corresponding to the diameters of the coins as the positions of the regulating pins; however, the pins are not arranged at suitable positions in some cases since the pins are set so as to correspond to the plurality of coins having different diameters. Specifically, if the straight line connecting the regulating pin and the contact point of the pushing piece and the circumferential surface of the coin passes through the center of the coin, the rotating disk is in a lock state sandwiching the coin, in other words, the sandwiching force of the coin is maximized, the sandwiching force is reduced as it gets away from the center of the coin, and the moving distance of the rotating disk in the circumferential direction is sequentially reduced; and, if they are too distant, the moving distance of the rotating disk in the circumferential direction is small and cannot be used in practice. If the sandwiching force is large, pressed dents are formed on the sandwiched coins; therefore, the pins are set at the positions where the moving distance is maximized within the range of the sandwiching force that does not form the pressed dents.

Coins of Japanese yen will be taken as examples for explanation. The diameter of a 500-yen coin which is a maximum diameter is 26.5 millimeters, and the 1-yen coin having the minimum diameter is 20 millimeters. Therefore, when the moving distance necessary for the 500-yen coin is taken into consideration, the connecting line is close to the coin center with respect to the 1-yen coin, wherein the sandwiching force is set to be larger than that of the optimum position thereof. Moreover, since the 1-yen coin is made of aluminum having low hardness, there is a problem that, in some cases, the coin may be sandwiched between the regulating pins and the pusher resulting in formation of a pressed dent.

In the fourth conventional technique, after the coins are sorted into the fan-shaped sorting concave parts of the rotating disk, the held coins are pushed in the circumferential direction of the rotating disk by the moving bodies, which move in the circumferential direction; therefore, there is an advantage that the coins having different diameters in a specified range can be suitably transferred to a next step. However, since the sorting concave parts holding the coins are open, no coin can be present at the position opposed to the sorting concave part at a feeding position; therefore, the rotating disk has to be inclined like the first conventional technique, and the storage amount of the coins is limited since the pressures applied to the moving bodies cannot be increased. In other words, there is a problem that the coin storage amount is small.

SUMMARY OF THE INVENTION

It is a first object of the present invention to provide a coin hopper that can feed coins having different diameters one by one at high speed without damaging the coins.

It is a second object of the present invention to provide a small coin hopper that can feed coins having different diameters one by one at high speed without significantly reducing the storage amount of the coins and without damaging the coins.

It is a third object of the present invention to provide a coin hopper that can feed coins having different diameters and transfer the coins to a carrier one by one at high speed without damaging the coins.

Other objects of the present invention which have not been described herein clearly will become apparent from the following explanation and the accompanying drawings.

The present invention has a below configuration in order to achieve the above described objects.

(1) A coin hopper comprising: a storing chamber storing the coins in bulk and formed a bottom hole; a sorting board having a circular through hole, in which is arranged the bottom hole of the storing chamber, causes the coins to drop from an upper side to a lower side through of the through hole by rotation of the sorting board; a pusher pushing out the coins one by one in an outer circumferential direction of the sorting board at a specified position in a back side of the sorting board; a coin holding plate having an approximately same diameter as the sorting board is arranged to be concentric and parallel to the sorting board with a specified interval below the sorting board to form a coin holding space; and a circumferential-direction passage that is continued to the coin holding space in a back side of the sorting board, is extending in the circumferential direction of the sorting board, and is formed of a front side guide positioned in a front position in a forward-rotation direction of the sorting board and a rear side guide positioned at a rear position thereof is formed; wherein; the pusher is provided to be movable at specified timing upon forward rotation of the sorting board between a pushing position that is in the back side of the sorting board and positioned in the coin holding space immediately below the through hole and a standby position that is in a rotating axis side of the sorting board, is in the side of the through hole, and is hidden below the sorting board; and, when the pusher is gradually moved from the standby position to the pushing position, reaches the pushing position at a position corresponding to the specified position, and is gradually moved to the standby position after reaching the pushing position, the coin is moved in the circumferential direction of the sorting board through the circumferential-direction passage from the through hole.

In the coin hopper of the first invention, the pusher of the coins is positioned at the standby position in the side of the through hole and hidden below the sorting board in the back side of the sorting board except when it is at a specified rotation angle position of the sorting board. Therefore, the coins in bulk are stirred by the sorting board, which rotates in the bottom hole of the storing chamber, the coins are dropped into the coin holding space one by one from the upper side to the lower side of the through holes, and the coins are sorted one by one. The sorted coins are pushed by the rear side guide in the back side of the sorting board and rotated together with the sorting board.

The pusher is moved at specified timing between the standby position and the pushing position, which is positioned in the coin holding space immediately below the through hole.

More specifically, the pusher is gradually moved from the standby position to the pushing position before a specified position for finally pushing out the coin, and, after reaching the specified position, the pusher is gradually moved from the pushing position to the standby position. The coin which has dropped into the coin holding space is moved in the circumferential-direction passage sequentially from the coin holding space toward the circumferential direction of the sorting board by the pusher, which is moved from the standby position to the pushing position in the above described manner, and, at the specified position, the coin is finally fed out. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that high-speed dispensing can be carried out without increasing the diameter of the sorting board.

(2) The coin hopper of above described (1), wherein it is preferred that a coin receiver be fixedly arranged in an attachment base side at a position opposed to a pusher formed in a circumferential edge side of the rear side guide in a lower side of a rib between the through holes and to a circumferential edge part of the sorting board; and, at the pushing position, the coin be pushed into a part between the coin receiver and the pusher by the pusher.

In this case, upon the forward rotation of the sorting board, the pusher is positioned at the standby position in the side of the through hole and hidden below the sorting board in the back side of the sorting board except when it is at a specified rotation angle position of the sorting board. Therefore, the coins in bulk are stirred by the sorting board, which rotates in the bottom hole of the storing chamber, the coins are dropped one by one from the upper side to the lower side of the through holes, and the coins are sorted one by one in the coin holding space. The sorted coins are pushed by the rear side guide in the back side of the sorting board and rotated together with the sorting board.

The pusher can be moved at specified timing between the standby position and the pushing position, which is positioned in the coin holding space immediately below the through hole.

More specifically, the pusher is gradually moved from the standby position to the pushing position before a specified position for finally pushing out the coin, and, after reaching the specified position, the pusher is gradually moved from the pushing position to the standby position. The coin which has dropped into the through hole and is positioned in the coin holding space is pushed by the pusher, which is moved from the standby position to the pushing position, is fed out to the circumferential-direction passage, is finally sandwiched between the pusher formed at the circumferential edge continued to the rear side guide and the coin receiver fixedly arranged in the outer side of the sorting board, and is moved along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

(3) In the coin hopper according to above described (1) or (2), wherein it is preferred that the sorting board can be rotated backward; and along with the backward rotation, the pusher be configured to be moved backward with respect to the forward rotation, and, in a zone in which the pusher is gradually moved from the pushing position to the standby position upon the forward rotation, the pusher be configured to be held at the standby position by a backward-rotation standby position holding cam.

In this case, the pusher of the coins is positioned at the standby position in the side of the through hole and hidden below the sorting board in the back side of the sorting board except when it is at a specified rotation angle position of the sorting board. Therefore, the coins in bulk are stirred by the sorting board, which rotates in the bottom hole of the storing chamber, the coins are dropped one by one from the upper side to the lower side of the through holes, and, then, the coins are held in the coin holding space. The sorted coins are pushed by the rear side guide in the back side of the sorting board and rotated together with the rotating disk.

The pusher is moved at specified timing between the standby position and the pushing position, which is positioned in the coin holding space immediately below the through hole.

More specifically, the pusher is gradually moved from the standby position to the pushing position before a specified position for pushing out the coin, and, after reaching the specified position, the pusher is gradually moved from the pushing position to the standby position. The coin which has dropped into the through hole is fed out through the circumferential-direction passage at the specified position by the pusher, which is moved from the standby position to the pushing position. After the pusher has fed out the coin to the circumferential-direction passage, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

Furthermore, since the sorting board can be rotated backward, when the sorting board cannot be rotated in the forward-rotation direction due to coin jamming or when no coin is fed out for specified time even when the sorting board is rotated in the forward-rotation direction, the sorting board can be stopped and then rotated backward. The coin jamming can be eliminated by losing the balance of the coins by this backward rotation. Then, upon the backward rotation of the sorting board, even at the phase toward the pushing position, the pusher is held at the standby position by the backward-rotation standby-position holding cam. Therefore, the coin which has been dropped into the coin holding space is prevented from being pushed in the circumferential direction of the sorting board. In other words, there is an advantage that the sorting board can be rotated backward without generating problems.

(4) A coin hopper comprising: a storing chamber storing the coins in bulk and formed a bottom hole; a sorting board having a circular through hole, in which is arranged the bottom hole of the storing chamber, causes the coins to drop from an upper side to a lower side through of the through hole by rotation of the sorting board; a pusher pushing out the coins one by one in an outer circumferential direction of the sorting board at a specified position in a back side of the sorting board; a coin holding plate having an approximately same diameter as the sorting board is arranged to be concentric and parallel to the sorting board with a specified interval below the sorting board to form a coin holding space; and a circumferential-direction passage that is continued to the coin holding space in a back side of the sorting board, is extending in the circumferential direction of the sorting board, and is formed of a front side guide positioned in a front position in a forward-rotation direction of the sorting board, a rear side guide positioned at a rear position thereof, and the coin holding plate is formed; wherein; the pusher is arranged so as to be able to advance to and retreat from the coin holding space; a driving cam is arranged below the coin holding plate; the pusher is drivably coupled to the driving cam via a through hole formed in the coin holding plate; the pusher is provided to be movable at specified timing upon forward rotation of the sorting board between a pushing position that is in the back side of the sorting board and positioned immediately below the through hole and a standby position that is in a rotating axis side of the sorting board, is in the side of the through hole, and is hidden below the sorting board; furthermore, a pusher is formed at a circumferential edge of the rear side guide, and a coin receiver is fixedly arranged in an attachment base side at a position opposed to a circumferential edge part of the sorting board; when the pusher is gradually moved from the standby position to the pushing position, reaches the pushing position at a position corresponding to the specified position, and is gradually moved to the standby position after reaching the pushing position, the coin is moved in the circumferential direction of the sorting board through the circumferential-direction passage from the through hole; and, at the pushing position, the coin is pushed into a part between the coin receiver and the pusher by the pusher.

In the coin hopper of the second invention, the pusher is positioned at the standby position in the side of the through hole and hidden below the sorting board in the back side of the sorting board except when it is at a specified rotation angle position upon forward rotation of the sorting board. Therefore, the coins in bulk are stirred by the sorting board, which rotates in the bottom hole of the storing chamber, the coins are dropped one by one from the upper side to the lower side of the through holes, and, then, the coins are sorted one by one in the coin holding space. The sorted coins are pushed by the rear side guide in the back side of the sorting board and rotated together with the sorting board.

The pusher can be moved at specified timing between the standby position and the pushing position, which is positioned in the coin holding space immediately below the through hole.

More specifically, the pusher is gradually moved from the standby position to the pushing position before a specified position for pushing out the coin, and, after reaching the specified position, the pusher is gradually moved from the pushing position to the standby position. The coin which has dropped into the through hole is fed to the circumferential-direction passage at the specified position by the pusher, which is moved from the standby position to the pushing position. The pusher formed at the circumferential edge continued to the rear side guide sandwiches the coin between the pusher and the coin receiver fixedly arranged in the outside of the sorting board and moves the coin along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the rotating disk.

Furthermore, there is an advantage that the structure is simple and takes low cost since the pusher is moved between the standby position and the moving position by the driving cam.

Furthermore, the coin which has been dropped into the through hole is fed out in the circumferential direction of the sorting board through the circumferential-direction passage while being held on the coin holding plate. Since the sorting board and the coin holding plate are integrally rotated, the gap therebetween is constant, and, even when the differences in the thicknesses of coin denominations are large, there is an advantage that coin jamming in which the coins are sandwiched between the sorting board and the base due to variations in the gaps between the sorting board and the base, which is separated from the sorting board and is provided in a fixed state, is prevented.

(5) In the coin hopper of above described (4), it is preferred that the sorting board can be rotated backward; and along with the backward rotation, the pusher be configured to be moved backward with respect to the forward rotation, and, in a zone in which the pusher is gradually moved from the pushing position to the standby position upon the forward rotation, the pusher be configured to be held at the standby position by a backward-rotation standby-position holding cam.

In this case, the pusher is positioned at the standby position in the side of the through hole and hidden below the sorting board in the back side of the sorting board upon forward rotation of the sorting board. Therefore, the coins in bulk are stirred by the sorting board, which rotates in the bottom hole of the storing chamber, the coins dropped one by one from the upper side to the lower side of the through holes and sorted one by one in the coin holding space pushed by the rear side guide in the back side of the sorting board and rotated together with the rotating disk.

The pusher is moved at specified timing between the standby position and the pushing position, which is positioned in the coin holding space immediately below the through hole.

More specifically, the pusher is gradually moved from the standby position to the pushing position before a specified position for pushing out the coin, and, after reaching the specified position, the pusher is gradually moved from the pushing position to the standby position. The coin which has dropped into the through hole is fed to the circumferential-direction passage at the specified position by the pusher, which is moved from the standby position to the pushing position. The pusher formed at the circumferential edge continued to the rear side guide sandwiches the coin between the pusher and the coin receiver fixedly arranged in the outside of the sorting board and moves the coin along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

Furthermore, there is an advantage that the structure is simple and takes low cost since the pusher is moved between the standby position and the moving position by the driving cam.

Furthermore, the coin which has been dropped into the through hole is fed out in the circumferential direction of the sorting board through the circumferential-direction passage while being held on the coin holding plate. Since the sorting board and the coin holding plate are integrally rotated, the gap therebetween is constant, and, even when the differences in the thicknesses of coin denominations are large, there is an advantage that coin jamming in which the coins are sandwiched between the sorting board and the base due to variations in the gaps between the sorting board and the base, which is separated from the sorting board and is provided in a fixed state, is prevented.

Moreover, since the driving cam holds the pusher at the standby position by the backward-rotation standby-position holding cam in the process of moving the pusher to the pushing position upon the backward rotation of the rotating disk, there is an advantage that coin jamming which occurs in a case in which the backward-rotation standby-position holding cam is not present can be prevented.

(6) In the coin hopper of above described (5), it is preferred that the backward-rotation standby-position holding cam be a groove cam, and a cam follower integrated with the pusher be inserted in the groove cam.

In this case, the pusher is positioned at the standby position in the side of the through hole and hidden below the sorting board in the back side of the sorting board except when it is at a specified rotation angle position upon forward rotation of the sorting board. Therefore, the coins in bulk are stirred by the sorting board, which rotates in the bottom hole of the storing chamber, the coins are dropped one by one from the upper side to the lower side of the through holes, and the coins are sorted one by one in the coin holding space. The sorted coins are pushed by the rear side guide in the back side of the sorting board and rotated together with the sorting board.

The pusher is moved at specified timing between the standby position and the pushing position, which is positioned in the coin holding space immediately below the through hole.

More specifically, the pusher is gradually moved from the standby position to the pushing position before a specified position for pushing out the coin, and, after reaching the specified position, the pusher is gradually moved from the pushing position to the standby position. The coin which has dropped into the through hole is fed to the circumferential-direction passage at the specified position by the pusher, which is moved from the standby position to the pushing position. The pusher formed at the circumferential edge continued to the rear side guide pushes the coin against the coin receiver fixedly arranged in the outside of the rotating disk and moves the coin along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

Furthermore, there is an advantage that the structure is simple and takes low cost since the pusher is moved between the standby position and the moving position by the cam follower inserted in the driving cam comprised of the groove cam.

Furthermore, the coin which has been dropped into the through hole is fed out in the circumferential direction of the rotating disk through the circumferential-direction passage while being held on the coin holding plate. Since the sorting board and the coin holding plate are integrally rotated, the gap therebetween is constant, and, even when the differences in the thicknesses of coin denominations are large, there is an advantage that coin jamming in which the coins are sandwiched between the sorting board and the base due to variations in the gaps between the sorting board and the base, which is separated from the sorting board and is provided in a fixed state, is prevented.

Moreover, since the driving cam holds the pusher at the standby position in the process in which the pusher is moved to the pushing position by the backward-rotation standby-position holding cam upon backward rotation of the sorting board, there is an advantage that coin jamming which occurs in the case in which the backward-rotation standby-position holding cam is not present can be prevented.

(7) In the coin hopper of above described (6), it is preferred that the groove cam connect, by a gentle curve, a semicircular base part and a semicircular tip part smaller than the base part and have an egg shape comprised of a pushing connection part from the base part to the tip part and a return connection part from the tip part to the base part; the center of the base part match the rotating axis of the sorting board; the tip part be arranged in the coin receiver side; and a backward-rotation groove cam that is connected to an intermediate part of the return connection part and holds the pusher practically immediately below the sorting board be formed.

In this case, the pusher is guided by the semicircular base part and is positioned at the standby position in the side of the through hole and hidden below the sorting board in the back side of the sorting board except when it is at a specified rotation angle position upon forward rotation of the sorting board. Therefore, the coins in bulk are stirred by the sorting board, which rotates in the bottom hole of the storing chamber, the coins are dropped one by one from the upper side to the lower side of the through holes, and, then, the coins are sorted one by one in the coin holding space. The sorted coins are pushed by the rear side guide in the back side of the sorting board and rotated together with the sorting board.

The pusher can be moved by the pushing connection part and the return connection part at specified timing between the standby position and the pushing position, which is positioned in the coin holding space immediately below the through hole.

More specifically, the pusher is gradually moved from the standby position to the pushing position before a specified position for pushing out the coin and, at the specified position, is guided to the small semicircular tip part. Then, the pusher is gradually moved from the pushing position to the standby position by the return connection part. The coin which has dropped into the through hole is fed to the circumferential-direction passage at the specified position by the pusher, which is moved from the standby position to the pushing position. The pusher formed at the circumferential edge continued to the rear side guide pushes the coin against the coin receiver fixedly arranged in the outside of the sorting board and moves the coin along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

Furthermore, there is an advantage that the structure is simple and takes low cost since the mobile object is moved between the standby position and the moving position by the cam follower inserted in the driving cam comprised of the groove cam.

Furthermore, the coin which has been dropped into the through hole is fed out in the circumferential direction of the rotating disk through the circumferential-direction passage while being held on the coin holding plate. Since the sorting board and the coin holding plate are integrally rotated, the gap therebetween is constant, and, even when the differences in the thicknesses of coin denominations are large, there is an advantage that coin jamming caused by the sorting board is prevented.

Moreover, since the driving cam holds the pusher at the standby position in the process in which the pusher is moved to the pushing position by the backward-rotation standby-position holding cam upon backward rotation of the sorting board, there is an advantage that coin jamming which occurs in the case in which the backward-rotation standby-position holding cam is not present can be prevented.

(8) In the coin hopper of above described (4), it is preferred that a rotating-direction rear position side of the through hole on an upper surface of the sorting board be formed into a slope, and a step is formed on a circumferential edge part thereof in a rotating-direction front position side.

In this case, the pusher is positioned at the standby position in the side of the through hole and hidden below the sorting board in the back side of the sorting board except when it is at a specified rotation angle position upon forward rotation of the sorting board. Therefore, the coins in bulk are stirred by the sorting board, which rotates in the bottom hole of the storing chamber, the coins are dropped one by one from the upper side to the lower side of the through holes, and, then, the coins are sorted one by one in the coin holding space. The sorted coins are pushed by the rear side guide in the back side of the sorting board and rotated together with the sorting board.

The pusher is moved at specified timing between the standby position and the pushing position, which is positioned in the coin holding space immediately below the through hole.

More specifically, the pusher is gradually moved from the standby position to the pushing position before a specified position for pushing out the coin, and, after reaching the specified position, the pusher is gradually moved from the pushing position to the standby position. The coin which has dropped into the through hole is fed to the circumferential-direction passage at the specified position by the pusher, which is moved from the standby position to the pushing position. The pusher formed at the circumferential edge continued to the rear side guide pushes the coin against the coin receiver fixedly arranged in the outside of the sorting board and moves the coin along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

Furthermore, there is an advantage that the structure is simple and takes low cost since the pusher is moved between the standby position and the moving position by the driving cam.

Furthermore, the coin which has been dropped into the through hole is fed out in the circumferential direction of the sorting board through the circumferential-direction passage while being held on the coin holding plate. Since the sorting board and the coin holding plate are integrally rotated, the gap therebetween is constant, and, even when the differences in the thicknesses of coin denominations are large, there is an advantage that coin jamming caused by the sorting board is prevented.

The rotating-direction front position side of the through hole is the step, and the rear position side thereof is a slope. Therefore, if the coins are not dispensed because the coins in a standing state leaning on the wall of the storing part are rotated together with the sorting board, vibrations are applied to the coins by the step in the rotating-direction front position side to give an opportunity to cause the coins to fall down into the through holes, and the coins fell down from the standing state are guided to the through holes by the slope in the rotation rear position side. Therefore, there is an advantage that the coins including the last one can be quickly fed out.

(9) A coin hopper comprising: a storing chamber storing the coins in bulk and formed a bottom hole; a sorting board having a circular through hole, in which is arranged the bottom hole of the storing chamber, causes the coins to drop from an upper side to a lower side through of the through hole by rotation of the sorting board; a pusher pushing out the coins one by one in an outer circumferential direction of the sorting board at a specified position in a back side of the sorting board; a coin holding plate having an approximately same diameter as the sorting board is arranged to be concentric and parallel to the sorting board with a specified interval below the sorting board to form a coin holding space; and a circumferential-direction passage that is continued to the coin holding space in a back side of the sorting board, is extending in the circumferential direction of the sorting board, and is formed of a front side guide positioned in a front position in a forward-rotation direction of the sorting board and a rear side guide positioned at a rear position thereof is formed; wherein; the pusher is arranged so as to be able to advance to and retreat from the coin holding space; a driving cam is arranged below the coin holding plate; the pusher is drivably coupled to the driving cam via a through hole formed in the coin holding plate; the pusher is provided to be movable at specified timing upon forward rotation of the sorting board between a pushing position that is in the back side of the sorting board and positioned immediately below the through hole and a standby position that is in a rotating axis side of the sorting board, is in the side of the through hole, and is hidden below the sorting board; a pusher is formed at a circumferential edge of the rear side guide, and a coin receiver is fixedly arranged in an attachment base side at a position opposed to a circumferential edge part of the sorting board; the pusher is gradually moved from the standby position to the pushing position, reaches the pushing position at a position corresponding to the specified position, and is gradually moved to the standby position after reaching the pushing position; at the pushing position, the coin is pushed into a part between the coin receiver and the pusher by the pusher; the coin receiver forms an arc shape about a specified shaft center; a pushing piece that rotates about the axis is provided; and the coin passed to the coin receiver by the pusher is moved along the coin receiver by the pushing piece.

In the coin hopper of a third invention, the pusher is positioned at the standby position in the side of the through hole and hidden below the sorting board in the back side of the sorting board except when it is at a specified rotation angle position upon forward rotation of the sorting board. Therefore, the coins in bulk are stirred by the sorting board, which rotates in the bottom hole of the storing chamber, the coins are dropped one by one from the upper side to the lower side of the through holes, and the coins are sorted one by one in the coin holding space. The coins are pushed by the rear side guide in the back side of the sorting board and rotated together with the sorting board.

The pusher can be moved at specified timing between the standby position and the pushing position, which is positioned in the coin holding space immediately below the through hole.

More specifically, the pusher is gradually moved from the standby position to the pushing position before a specified position for pushing out the coin, and, after reaching the specified position, the pusher is gradually moved from the pushing position to the standby position. The coin which has dropped into the through hole is fed to the circumferential-direction passage at the specified position by the pusher, which is moved from the standby position to the pushing position. The pusher formed at the circumferential edge continued to the rear side guide sandwiches the coin between the pusher and the coin receiver fixedly arranged in the outside of the sorting board and moves the coin along the coin receiver. After the pusher has fed out the coin, the pusher is gradually moved from the pushing position and is returned to the standby position.

Therefore, the coin is proactively fed in the circumferential direction of the sorting board by the movement of the pusher, which is different from sandwiching the coin and moving the coin by the circumferential-direction vector with respect to the coin generated by the component force thereof. Therefore, there is an advantage that no pressed dent is formed on the coin.

Moreover, since the coins are dropped into the through hole formed in the sorting board to sort the coins one by one, there is an advantage that the coins can be sorted one by one, and the apparatus can be downsized without increasing the diameter of the sorting board.

Furthermore, there is an advantage that the structure is simple and takes low cost since the mobile object is moved between the standby position and the moving position by the driving cam.

Furthermore, the coin which has been dropped into the through hole is fed out in the circumferential direction of the sorting board through the circumferential-direction passage while being held on the coin holding plate. Since the sorting board and the coin holding plate are integrally rotated, the gap therebetween is constant, and, even when the differences in the thicknesses of coin denominations are large, there is an advantage that coin jamming in which the coins are sandwiched between the sorting board and the base due to variations in the gaps between the sorting board and the base, which is separated from the sorting board and is provided in a fixed state, is prevented.

Moreover, there is an advantage that the coin pushed against the coin receiver by the pusher is moved along the coin receiver by the rotating pushing piece, and passing to the coin receiver can be smoothly carried out.

BRIEF DESCRIPTION OF THE DRAWINGS

The features and advantages of the invention will be more clearly understood from the following description taken in conjunction with the accompanying drawings.

DETAILED DESCRIPTION OF THE PREFERRED EMBODIMENTS

Embodiments of the present invention will be described below with reference to the accompanying drawings.

First Embodiment

Figure 1:
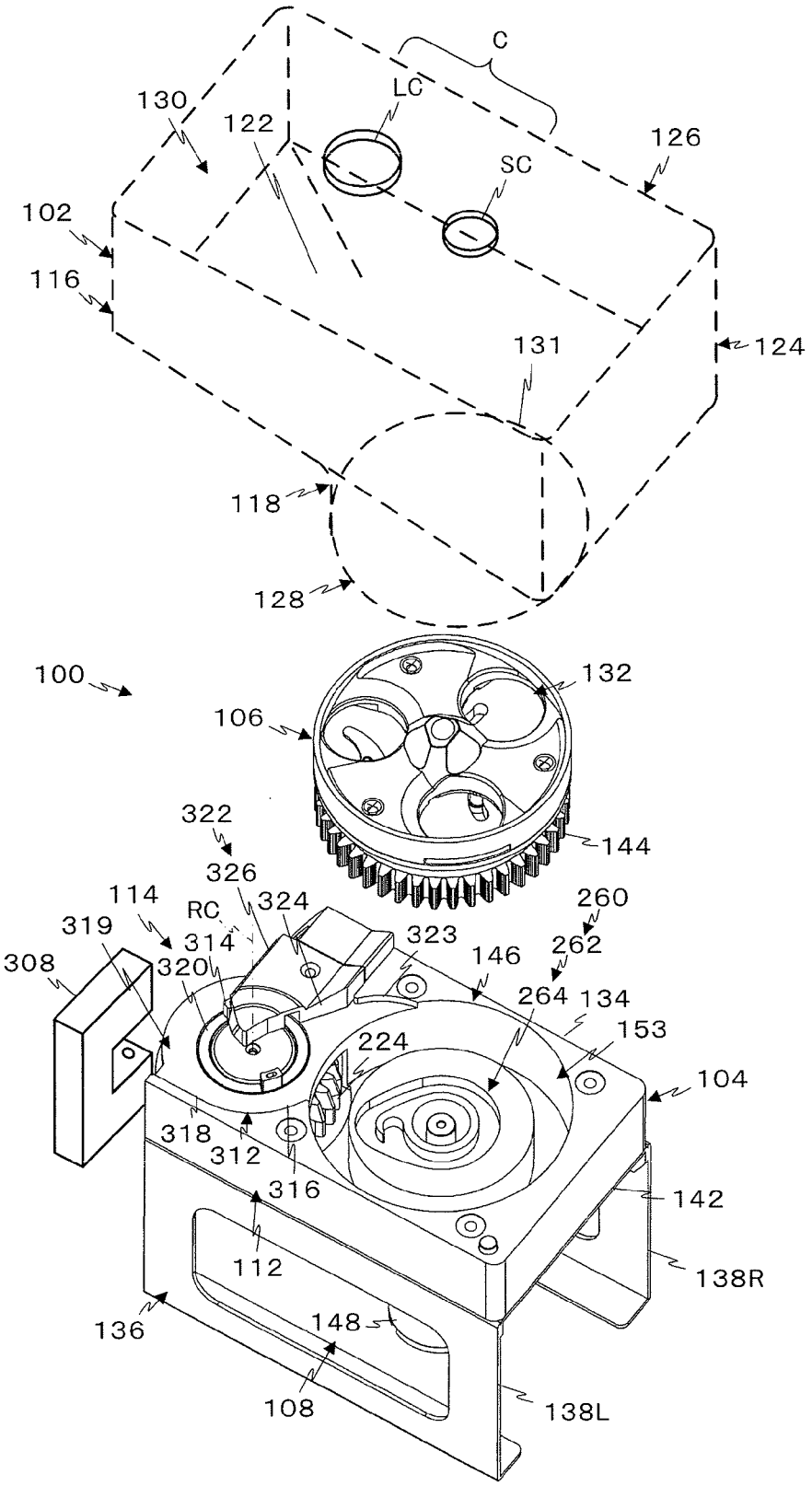
FIG. 1 is an exploded perspective view of a coin hopper of a first embodiment of the present invention.

As shown in FIG. 1, a coin hopper 100 of a first embodiment has a function to sort coins C in bulk one by one by the rotation of a rotating disk 106 and then feed the coins in the circumferential direction of the rotating disk 106; and the coin hopper 100 includes a storing bowl 102 which stores many coins in bulk, an attachment base 104 which fixes the storing bowl 102, the rotating disk 106 (sorting board 154) which sorts the coins C one by one, a driver 108 of the rotating disk 106, a coin receiver 112, and a carrier 114 of the coins C. However, the coin receiver 112 and the carrier 114 are not essential components. The coins C are assumed to have a plurality of denominations, at least have a maximum diameter coin LC and a minimum diameter coin SC, and include one or more coins having a diameter(s) between the maximum diameter coin LC and the minimum diameter coin SC.

Therefore, in the present specification, if a coin does not correspond to any of the particular coins, the coin is shown as a coin C; and, if a particular coin is to be explained, the coin is shown as the maximum diameter coin LC or the minimum diameter coin SC.

First, the storing bowl 102 will be explained.

The storing bowl 102 has a function to store many coins C in bulk and feed the coins to the rotating disk 106.

The storing bowl 102 has a vertical tubular shape extending above the attachment base 104, which is approximately horizontally arranged. An upper portion 116 thereof has a rectangular cross section, a lower portion 118 thereof has a circular cross section, a bottom wall 122 inclined toward the rotating disk 106 side is formed to connect the upper portion 116 and the lower portion 118 to each other, and the storing bowl is configured so that the coins C slip down on the bottom wall 122 toward the lower portion 118 by their own weight. In other words, the storing bowl 102 has ahead 124 of which bottom wall 122 is inclined downward toward the rotating disk 106, a coin input opening 126 for loading the coins C, and an outer cover 128 surrounding at least the upper outer circumference of the rotating disk 106.

In the outer cover 128, a lower end surface thereof is closely in contact with the attachment base 104, and is detachably fixed to the attachment base 104.

The height of the circular cross-sectional portion of the lower portion 118 is formed to be smaller than the diameter of the minimum diameter coin SC so that the coins C do not easily stand to lean on the inner wall of the lower portion 118.

The outer cover 128 has a cylindrical ring shape, and the circular space surrounded thereby constitutes a bottom hole 131 of a storing chamber 130.

Therefore, the storing chamber 130, which is tapered downward as a whole, is formed by the upper portion 116 and the lower portion 118. The coins C having different diameters are stored in bulk in the storing bowl 102, i.e., in the storing chamber 130, slip down on the inclined bottom wall 122 by their own weight, and are fed to the rotating disk 106.

Furthermore, the coins C stirred by the rotating disk 106 drop to through holes 132 of the rotating disk 106 while variously changing the positions thereof.

Next, the attachment base 104 will be explained with reference to FIG. 1 and FIG. 2.

The attachment base 104 has a function to rotatably support the rotating disk 106, detachably fix the storing bowl 102, attach the driver 108, etc.

The attachment base 104 includes a horizontal loading board 134 comprised of a thick rectangular board and a reverse-channel-shaped leg 136 holding the loading board 134 by placing the loading board 134 on a top part thereof. The leg 136 includes supporting side walls 138L and 138R, which are approximately vertically arranged, and a top board 142, on which the loading board 134 is placed.

Next, the loading board 134 will be explained.

The loading board 134 has a thick rectangular board shape molded by a resin having antifriction properties. For example, a circular storage hole 146, which houses a gear wheel 144, etc. attached to the lower side of the rotating disk 106, is formed in an upper surface thereof; and an electric motor 148 serving as the driver 108 of the rotating disk 106 is attached to a back side thereof.

The storage hole 146 is a circular hole having a diameter slightly larger than that of the rotating disk 106 and has a depth in which most of the rotating disk 106 sink. A concave outlet groove 151 is formed in part of a periphery of the storage hole 146.

At the center of the storage hole 146, part of a pusher driver 260 is formed at a specified height.

Therefore, in the present first embodiment, the storage hole 146 is formed into a storage groove 153 having a circular ring shape.

Next, the leg 136 will be explained.

The leg 136 has a function to support the attachment base 104.

The leg 136 has agate shape in a front view and is formed by bending a flat board by a specified angle, for example, by a vendor. In the present first embodiment, the top board 142 is horizontally arranged, but may be inclined.

Next, the rotating disk 106 will be explained with reference to FIG. 3 to FIG. 6.

The rotating disk 106 has a function to be rotated as a whole when receiving driving force from the electric motor 148, sort the coins C in bulk one by one, feed the coins in the circumferential direction of the rotating disk 106, and transfer the coins to the coin receiver 112.

In the first embodiment, the rotating disk 106 includes the sorting board 154, a coin holding plate 156, and a gear 158. However, the rotating disk 106 is only required to include at least the sorting board 154 and the coin holding plate 156.

All of the sorting board 154, the coin holding plate 156, and the gear 158 are integrally molded. Alternatively, two of them are selectively integrated. Alternatively, after they are individually formed, they can be assembled. In the present first embodiment, the gear 158 is integrally formed with the coin holding plate 156. However, this is an example for rotating and driving the rotating disk 106, and the gear 158 is not an essential component.

Next, the sorting board 154 will be explained mainly with reference to FIG. 2 and FIG. 3.

The entirety or part of the sorting board 154 is arranged in the bottom hole 131 of the storing bowl 102 or immediately below the bottom hole 131 and has a function to stir the coins C in the storing chamber 130, cause the coins C to drop from the upper side to the lower side, and sort the coins C one by one. In the present first embodiment, the sorting board 154 has a disk shape having a specified thickness and is arranged at a highest position in the rotating disk 106.

First, the shape of the upper surface of the sorting board 154 will be explained.

In the present first embodiment, if a plurality of parts having the same function and the same shape such as the through holes 132 are present, they are only denoted with numbers. In a case in which they have to be particularly distinguished from each other for explanation, they are explained by denoting the numbers with A, B, and C of alphabets.

The sorting board 154 has a disk shape approximately having a thickness as a whole and, in the present first embodiment, includes a center protrusion 162, a holding surface 166, and a ring 167. However, the center protrusion 162 and the ring 167 are not essential components.

Next, the center protrusion 162 will be explained.

The center protrusion 162 has a function to stir the coins C in the bottom hole 131.

The center protrusion 162 has a truncated conical shape at the center of the upper surface of the sorting board 154, and plane parts 162A, 162B, and 1620 are formed respectively at the equal radial positions with respect to a rotating axis CE of the sorting board 154.

Next, the holding surface 166 will be explained.

The holding surface 166 has a function to define the through holes 132 and stir the coins C.

The holding surface 166 is an approximately flat surface formed like a ring around the center protrusion 162.

Next, the through holes 132 will be explained.

The through holes 132 has a function to cause the coins C to drop from the upper side to the lower side by the own weight thereof and sort the coins one by one.

The through holes 132 are formed in the holding surface 166, have a diameter slightly larger than the used maximum diameter coin LC, and are vertically penetrating therethrough. A specified number of, in the present first embodiment, three through holes 132A, 132B, and 132C are formed at regular intervals. However, the number of the through holes 132 is not limited to that of the present first embodiment, but may be two, four, or more.

Therefore, between the through holes 132A, 132B, and 132C, ribs 172A, 172B, and 172C having fan shapes which are expanded in the circumferential edge side of the sorting board 154 are formed at regular intervals. Respectively at the ribs 172A, 172B, and 172C, raising parts 174A, 174B, and 174C having ax shapes in a planar view are formed from a base part of the center protrusion 162 toward the circumferential edge of the sorting board 154.

Since the positional relations between the through holes 132A, 132B, and 132C and the raising parts 174A, 174B, and 174C are equal, the raising part 174C will be representatively explained.

Between the raising part 174C and the through hole 132B positioned in the rotating-direction front side of the raising part 174C, an upwardly slope 176B having an approximately the same width is formed from the circumferential edge of the through hole 132B toward the raising part 174C. By virtue of the upwardly slope 176B, the coins C are configured to easily get over the raising part 174C when the coins C are guided to the upwardly slope 176B, thereby preventing occurrence of coin jamming.

Figure 8:
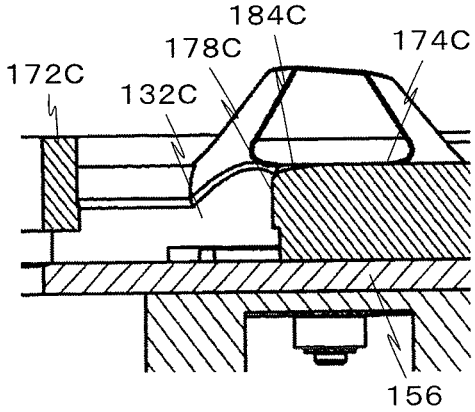
FIG. 8 is a C-C-line cross-sectional view of FIG. 4.
Figure 9:
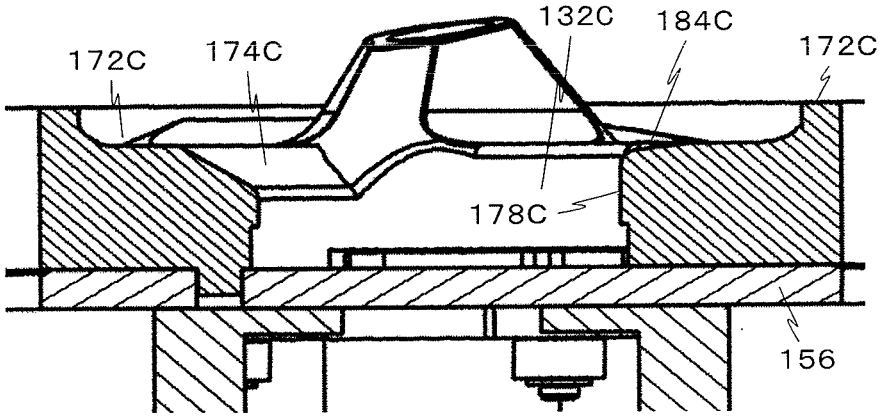
FIG. 9 is a D-D-line cross-sectional view of FIG. 4.

A step 178C (FIG. 8) approximately vertically rising from the circumferential edge of the through hole 132C is formed in most of the part from a base part of the center protrusion 162 in the rotating-direction rear position side of the raising part 174C toward the circumferential edge. A tip part is formed into a straight part 182C extending straight toward the direction of the circumferential edge of the sorting board 154. Between the straight part 182C and the through hole 132C, a rotation front-position-side inclined surface 184C (FIG. 8) is formed from the circumference of the through hole 132C toward the straight part 182C.

At the total circumferential edge of the sorting board 154, the ring 167 having a specified height is formed. If the sorting board 154 is molded by a resin, the ring 167 is preferred to be provided in order to maintain specified strength; however, if the strength is sufficient, the ring is not required to be provided. An upper end of the ring 167 is set so as to be positioned slightly above the upper surface of the raising part 174C, and the part between the ring and the upper surface of the raising part is formed into a connection part 186C having an inclined surface or a concave surface. This is for causing the coin C placed on the connection part 186C to easily fall down.

Through holes 187A, 187B, and 187C are formed to vertically penetrate through the vicinities of the circumferential edges of the raising parts 174A, 174B, or 174C. Screws 189A, 189B, and 189C for integrating the sorting board 154 and the coin holding plate 156 is penetrating therethrough.

A circular attachment hole 188 is formed along the rotating axis CE of the sorting board 154, and a small-diameter tip 190 of a later-described rotating shaft 189 is inserted and fixed therein.

Figure 5:
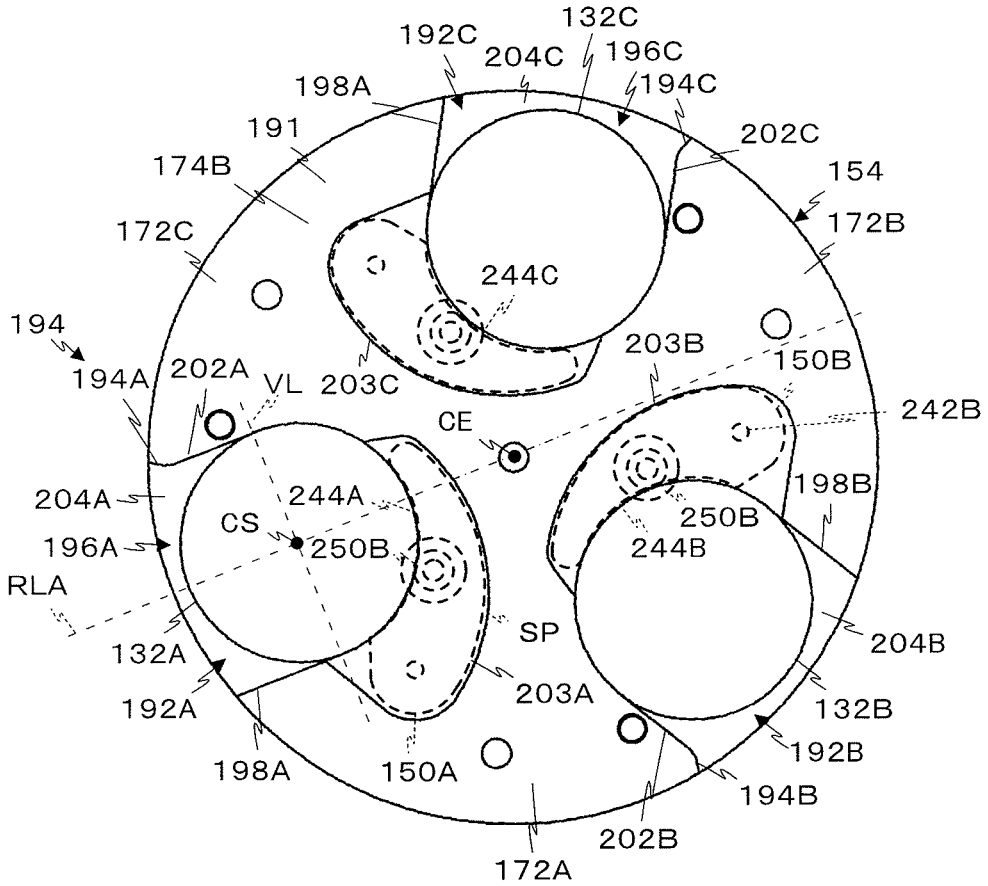
FIG. 5 is a back side view of the rotating disk used in the coin hopper of FIG. 1.

Next, the shape of a back side 191 of the sorting board 154 will be explained main with reference to FIG. 5.

On the back side 191 of the sorting board 154, circumferential-direction passages 192A, 192B, and 192C and pushers 194A, 194B, and 194C are formed to correspond to the through holes 132A, 132B, and 132C, respectively. In the present first embodiment, the circumferential-direction passages 192A, 192B, and 192*c* and the pushers 194A, 194B, and 194C have the same functions and the same shapes. Therefore, hereinafter, the circumferential-direction passage 192A and the pusher 194A will be representatively explained, the circumferential-direction passages 192B and 192C are denoted by alphabets B and C corresponding to the same number, and the explanation thereof will be omitted.

First, the circumferential-direction passage 192A will be explained.

The circumferential-direction passage 192A has a function to guide the coin C, which has dropped into the through hole 132A, in the circumferential direction of the sorting board 164.

The circumferential-direction passage 192A is comprised of a groove 196A, which is formed on the back side of the sorting board 154 and has a reverse channel cross-sectional shape, and the coin holding plate 156. The groove 196A is linearly formed in the circumferential direction from an end of the through hole 132A to be parallel to a radiation line RLA, which is extending through the rotating axis CE of the sorting board 154 and a center CS of the through hole 132A. The groove is a passage having a rectangular cross section surrounded by a slender-planar-shaped front side guide 198A positioned at a front position in the rotating direction of the sorting board 164, a slender-planar-shaped rear side guide 202A positioned at a rear position in the rotating direction, a top surface 204 of the groove 196A, and the upper surface of the coin holding plate 156. Therefore, base ends of the front side guide 198A and the rear side guide 202A pass through the center CS and are at the positions where a virtual line VL, which is orthogonally intersecting with the radiation line RLA, and the circumferential edge of the through hole 132A intersect with each other. The heights of the front side guide 198A and the rear side guide 202A (in the thickness direction of the sorting board 154) are formed to be slightly larger than the thickness of a thickest coin. When the sorting board 164 is rotated forward, the rear side guide 202A pushes the circumferential surface of the coin C to rotate the coin therewith. When the rotating disk 106 is rotated backward, the front side guide 198A pushes the circumferential surface of the coin C to rotate the coin therewith.

Next, the pusher 194A will be explained.

The pusher 194A has a function to push out the coin C toward the coin receiver 112 at the end and is a part which is continued to the rear side guide 202A and is positioned at the circumferential edge of the sorting board 154. In the present first embodiment, the pusher is formed into a flat surface which forms an angle of about 150 degrees with respect to the rear side guide 202A, and the pusher is connected to the rear side guide 202A by a gentle curve line. The pusher 194A is not limited to a flat surface, but may have an arc shape, and a small bearing may be further arranged. If needed, the pusher 194A is preferred to employ a structure that does not leave scars on the circumferential surface of the coin for pushing the circumferential surface of the coin C.

Next, a pusher standby groove 203A will be explained.

The pusher standby groove 203A has a function to store the entirety of a pusher 150A, which is positioned at a standby position SP. In the present specification, "to store the entirety of the pusher 150A" refers to a case which is not practically different from a completely stored state in terms of working/effects. In other words, this refers to a state in which the entirety of the pusher 150A is practically stored in the pusher standby groove 203A and also refers to a state that it is practically immediately below the sorting board 154.

The pusher standby groove 203A is formed into a crescent shape continued to a lower end part of the through hole 132A in the rotating axis CE side. However, the shape of the pusher standby groove 203A is not limited to the crescent shape, but may be another shape as long as it has the same function.

Figure 6:
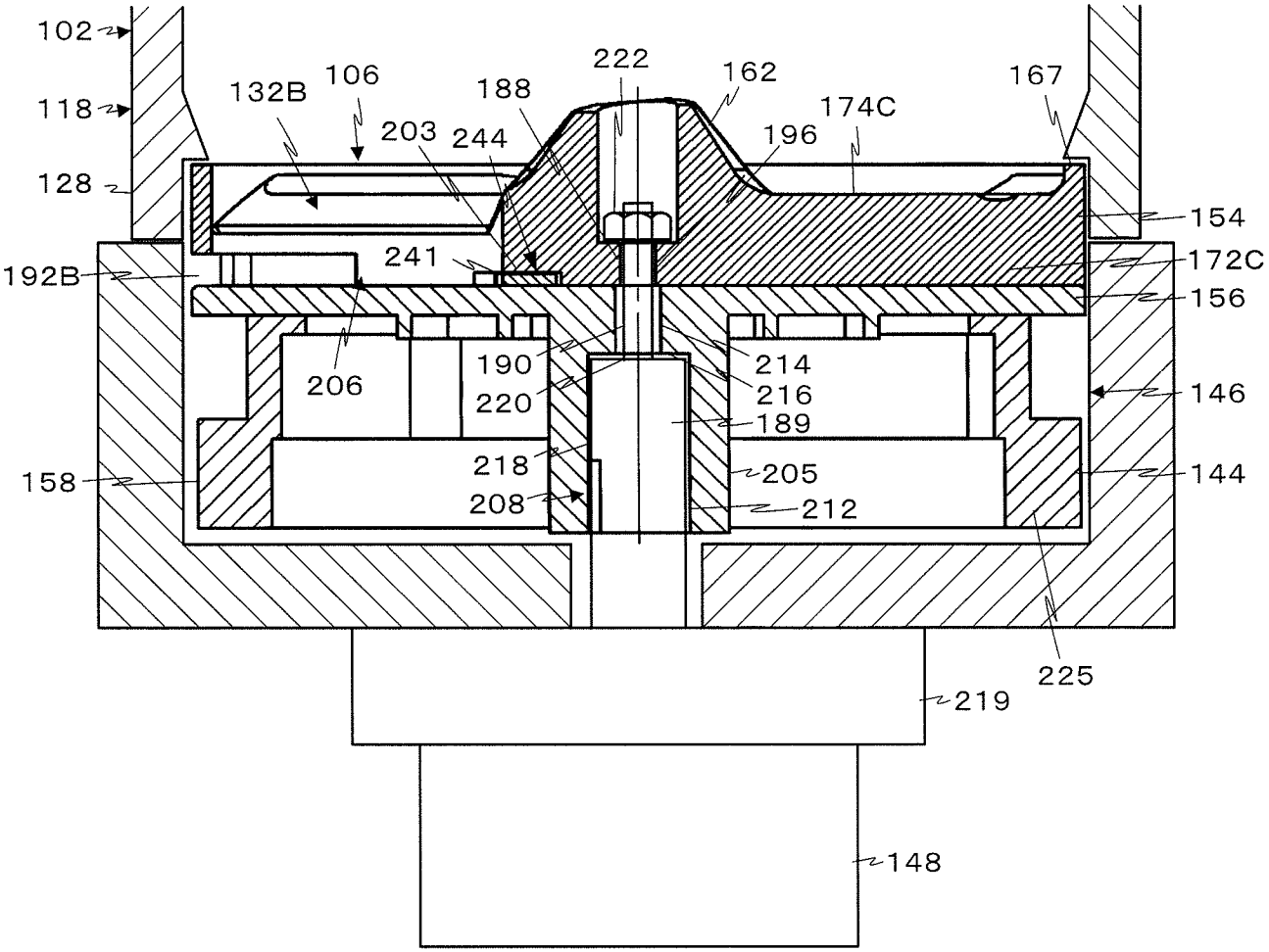
FIG. 6 is an A-A-line cross-sectional view of FIG. 4.
Figure 7:
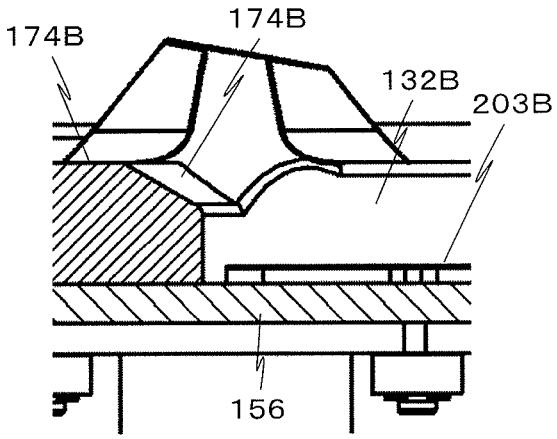
FIG. 7 is a B-B-line cross-sectional view of FIG. 4.

Next, the coin holding plate 156 will be explained mainly with reference to FIG. 3 and FIG. 6.

The coin holding plate 156 has a function to hold the coins C, which have dropped into the through holes 132, on the upper surface thereof and forms a disk shape having the same diameter as that of the sorting board 154. In the present first embodiment, in the coin holding plate 156, the upper surface thereof is a flat surface, and a columnar attachment boss 205 surrounding the rotating axis CE is formed to have a specified length at a center part on the lower surface thereof. Therefore, when the lower surfaces of the ribs 172 of the sorting board 154 are practically closely fixed to the upper surface of the coin holding plate 156, coin holding spaces 206 are formed immediately below the through holes 132A, 132B, and 132C, and the circumferential-direction passages 192A, 192B, and 192C are formed. Therefore, the heights of the coin holding spaces 206 and the circumferential-direction passages 192A, 192B, and 192C are the same with each other and are formed to be slightly higher than the thickness of the thickest coin. Therefore, the surfaces of the coins C, which have dropped into the through holes 132A, 132B, and 132C, are brought into contact with and held by the coin holding plate 156 in the coin holding space 206, and the coins can be slipped on the coin holding plate 156 and moved to the outer circumferential side of the rotating disk 106 from the coin holding space 206 through the circumferential-direction passages 192A, 192B, and 192C.

When each of the pushers 150A, 150B, and 150C is moved from the standby position SP to pushing position PP and is moved from the pushing position PP to the standby position SP, the pusher 150 can be advanced or retreated into/from the coin holding space 206.

A shaft hole 208 is penetrating through a shaft center part of the attachment boss 205. The shaft hole 208 is formed of a large diameter hole 212, which is a lower portion, and a small diameter hole 214, which is an upper portion. A step 216 is formed between the large diameter hole 212 and the small diameter hole 214.

The rotating shaft 189 is composed of a large-diameter shaft 218, which is a lower portion, and a small-diameter tip 190, which is an upper portion; and a shoulder 220, which is a step, is formed therebetween. The rotating shaft 189 is an output shaft of a decelerator 219 attached to the back side of the attachment base 104, the large-diameter shaft 218 penetrates through the shaft hole 208, the small-diameter tip 190 penetrates through the small diameter hole 214, and the shoulder 220 is received by the step 216. Thus, the height position of the rotating disk 106 is determined. The sorting board 154 and the coin holding plate 156 are fixed and integrated by screwing a nut 222 in a screw part of the small-diameter tip 190.

The decelerator 219 is subjected to rotary drive by the electric motor 148 fixed to the back side thereof.

Next, the gear 158 will be explained with reference to FIG. 3 and FIG. 6.

The gear 158 has a function to subject a moved gear 224 to rotary drive.

In the present first embodiment, the gear 158 is formed by forming a gear wheel 144 on the outer circumferential surface of a cylindrical part 225, which is formed downward from an outer circumferential edge of the coin holding plate 156 by a specified length. In other words, it has a shape that a bottomed cylindrical body, in which the coin holding plate 156 and the cylindrical part 225 are integrally formed, is reversed, and the circumferential surface of the cylindrical part 225 is formed into the gear wheel 144. The outer diameter of the gear wheel 144 is the same as that of the coin holding plate 156, and a gear made of a resin molding product, a plate pressed product, or the like is used. The gear wheel 144 has a function to drive a later-described moved gear 224; therefore, if the moved gear 224 is rotated synchronously with the rotating disk 106 by another means, the gear 158 can be eliminated.

In the present first embodiment, the sorting board 154 and the coin holding plate 156 are integrated by an integrating device 226. When integrated, the lower surface of the pusher standby groove 203 is covered by the upper surface of the coin holding plate 156. Therefore, a pusher standby space 244 of which coin holding space 206 side is formed into a slit-shaped opening 241 is formed.

The integrating device 226 is integrated by screwing screws 189A, 189B, and 189C, which are inserted in through holes 187A, 187B, and 187C formed in the ribs 172, into screw holes 234A, 2348, and 234C formed in the coin holding plate 156. However, the integrating device 226 is not limited to this, and another structure or means that, for example, integrally molds the sorting board 154, the coin holding plate 156, and the gear 158 can be used.

Next, the arrangement of the rotating disk 106 will be explained with reference to FIG. 1 and FIG. 6.

The rotating disk 106 is rotatably arranged in the storage hole 146 so that the upper surface of the sorting board 154 approximately matches the upper surface of the attachment base 104.

The lower end surface of the lower portion 118 of the storing bowl 102 is in contact with the upper surface of the attachment base 104 and fixed to the attachment base 104 so that the shaft center of the bottom hole 131 matches the shaft center of the rotating shaft 189. In this attached state, the internal edge of the bottom hole 131 is arranged so as to cover the upper side of the ring 167 as shown in FIG. 6. This is for avoiding a situation that the coins C lean on the inner circumferential surface of the storing bowl 102 and that the lower circumferential surfaces of the coins C continue a state placed on the ring 167 and do not fall into the through holes 132 in a case in which the number of the stored coins C is small.

The outer circumferential end of each of the circumferential-direction passages 192A, 192B, and 192C is opposed to the inner circumferential surface of the storage hole 146 approximately by three-quarters circumference thereof and is opposed to the formed outlet groove 151 by about quarter circumference thereof in the side of the coin receiver 112. In other words, if the entire surface of the end part of each of the circumferential-direction passages 192A, 192B, and 192C is opposed to the outlet groove 151, the coin C can be moved to the outlet groove 151.

Next, the electric motor 148 will be explained.

The electric motor 148 is a direct-current electric motor and is a reversible electric motor, which can be reversed if electric connection is reversed. In other words, the sorting board 154 can be rotated forward or rotated backward. In the present first embodiment, forward rotation is the case in which the rotating disk 106 is rotated counterclockwise in FIG. 2, and backward rotation is the case in which it is rotated clockwise.

Next, a pushing device 152 will be explained mainly with reference to FIG. 3.

The pushing device 152 has a function to move the coin C, which has dropped into the through hole 132 and is held on the coin holding plate 156, in the circumferential direction of the sorting board 154 through the circumferential-direction passage 192 at specified timing.

In the present first embodiment, the pushing device 152 is integrated with the coin holding plate 156 and includes the pushers 150A, 150B, and 150C and the pusher driver 260.

First, the pushers 150A, 150B, and 150C will be explained.

Each of the pushers 150A, 150B, and 150C has a function to move the coin C, which has dropped into the through hole 132A, 132B, or 132C and is held on the coin holding plate 156, in the circumferential direction of the rotating disk 106 through the circumferential-direction passage 192 at specified timing.

The pushers 150A, 150B, and 150C are provided to correspond to the through holes 132A, 132B, and 132C, respectively. However, herein, only the pusher 150B will be explained. The parts corresponding to the other pushers 150A and 150C are denoted by the same number with A or C, and explanation thereof will be omitted.

The pusher 150B is formed into an arc shape which is wide in a supporting shaft 242B side and is narrowed as it gets closer to the tip thereof, and the downward supporting shaft 242B is fixed to the end part in the wide side. The supporting shaft 242B is inserted in a shaft hole 244B, which is formed in the coin holding plate 156 at a position opposed to a pusher holding groove 203B, and is rotatably attached by a washer 246B and an E-ring 248B, which are arranged in the lower surface side of the coin holding plate 156, so as not to fall. When the pusher 150B is positioned at the standby position SP, a pushing edge 250B in the coin holding space 206 side is set so as to be overlapped with the internal edge of the through hole 132B or at a position slightly behind the internal edge in a case the sorting board 154 is viewed by a planar view.

A follower supporting shaft 252B is fixed downward from an intermediate part of the pusher 150B, is extended to the coin holding plate 156 through a third through hole 254B, which is formed in an arc shape for which the axis of the shaft hole 244B serves as a pivot point, a cam follower 256B is rotatably attached to a tip part thereof, and it is prevented from falling by an E-ring 258B. The cam follower 256B is inserted and arranged in a groove cam 264, which will be described later.

A first end of the third through hole 254B is formed in the vicinity of the follower supporting shaft 252B at the standby position SP of the pusher 150B, and a second end thereof is at the pushing position PP of the pusher 150B to which it can be moved.

By virtue of the above described structure, the pusher 150B can carry out swing motions while using the supporting shaft 242B as the pivot point, and the swing range thereof is a range between the standby position SP behind the lower side of the sorting board 154 and the pushing position PP, which is advanced to the lower side of the through hole 132B and positioned in the coin holding space 206, with respect to the coins C stored in bulk in the storing bowl 102. The swing motions of the pusher 150B are carried out by the pusher driver 260.

Next, the pusher driver 260 will be explained mainly with reference to FIG. 1 and FIG. 10.

The pusher driver 260 has a function to move the pusher 150 to the standby position SP and the pushing position PP at specified timing.

The pusher driver 260 in the present first embodiment is in the storage hole 146 of the attachment base 104 and is a driving cam 262 arranged in a fixed state below the coin holding plate 156.

The driving cam 262 is the groove cam 264 in which a specified width is continued as a whole by an external edge 266 and an internal edge 268 and includes a base part 272, a tip part 274, a pushing connection part 276, a return connection part 278, and a backward-rotation groove cam 302.

The base part 272 of the groove cam 264 is semicircular, and the center of the semicircle matches rotating axis CE of the rotating disk 106.

The tip part 274 is a semicircle (small semicircle) which has a center at a second axis CE2 distant from the rotating axis CE and has a smaller radius than that of the base part 272.

Figure 10:
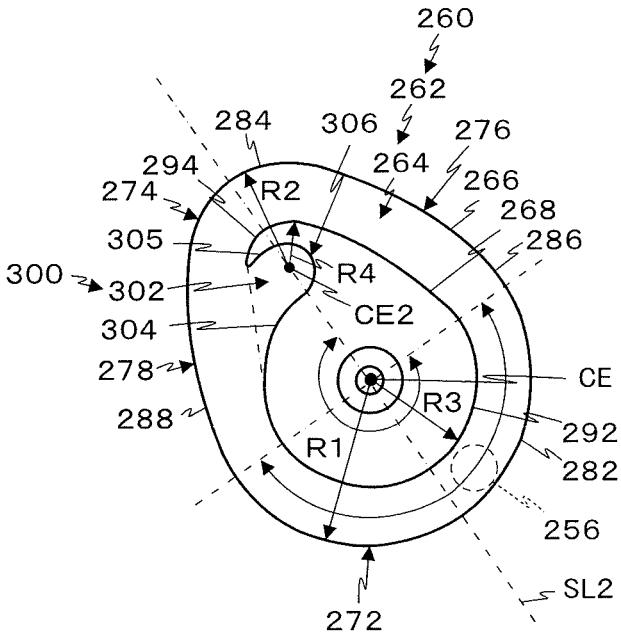
FIG. 10 is a front view of a driving cam used in the coin hopper of FIG. 1.

The pushing connection part 276 is an arc-shaped edge connecting right-side end parts of the base part 272 and the tip part 274 in FIG. 10.

Thus, the pushing connection part 276 is in the course in which the cam follower 256A, 256B, and 256C are pushed out from the standby position SP toward the pushing position PP.

The return connection part 278 connects left-side end parts of the base part 272 and the tip part 274 in FIG. 10 by an arc-shaped line. The return connection part 278 is in the course in which the cam followers 256A, 256B, and 256C are returned from the pushing positions PP to the standby positions SP. In other words, as described later, the return connection part 278 is a zone in which the pushers 150A, 150B, and 150C are gradually moved from the pushing positions PP toward the standby positions PP upon forward rotation.

The groove cam 264 is formed into an egg shape as a whole by the base part 272, the tip part 274, the pushing connection part 276, and the return connection part 278.

In other words, the external edge 266 has an egg shape formed by: an base external edge 282, which has an approximately semicircular shape formed by a first radius R1 using the rotating axis CE of the rotating disk 106 as a center; a tip external edge 284, which has an approximately semicircular shape formed by a second radius R2 smaller than that of the base external edge 282 and using the second axis CE2 as a center; a right connection external edge 286, which connects the part between the right sides of the base external edge 282 and the tip external edge 284 by a gentle curve; and a left connection external edge 288, which connects the part between left sides of the base external edge 282 and the tip external edge 284 by a gentle curve. The external edge 266 and the internal edge 268 have a specified constant interval so that the cam followers 256A, 256B, and 256C can move therebetween. In other words, the cam followers 256A, 256B, and 256C are guided by the external edge 266 and the internal edge 268.

The internal edge 268 has an egg shape, which is formed into a shape approximately similar to the external edge 266, inside the external edge 266. More specifically, the internal edge is connected by: a base internal edge 292, which has an approximately semicircular shape formed by a third radius R3 concentric to the rotating axis CE of the rotating disk 106; a tip internal edge 294, which has an approximately semicircular shape formed by a fourth radius R4 smaller than that of the base internal edge 292 and using the second axis CE2 as a center; and a right connection internal edge 296, which is a gentle curve between right sides of the base internal edge 292 and the internal tip edge 294. The pushing connection part 276 is positioned so as to sequentially get away from the rotating axis CE toward the tip part 274, and the return connection part 278 is positioned so as to get close to the rotating axis CE from the tip part 274 side.

Figure 2:
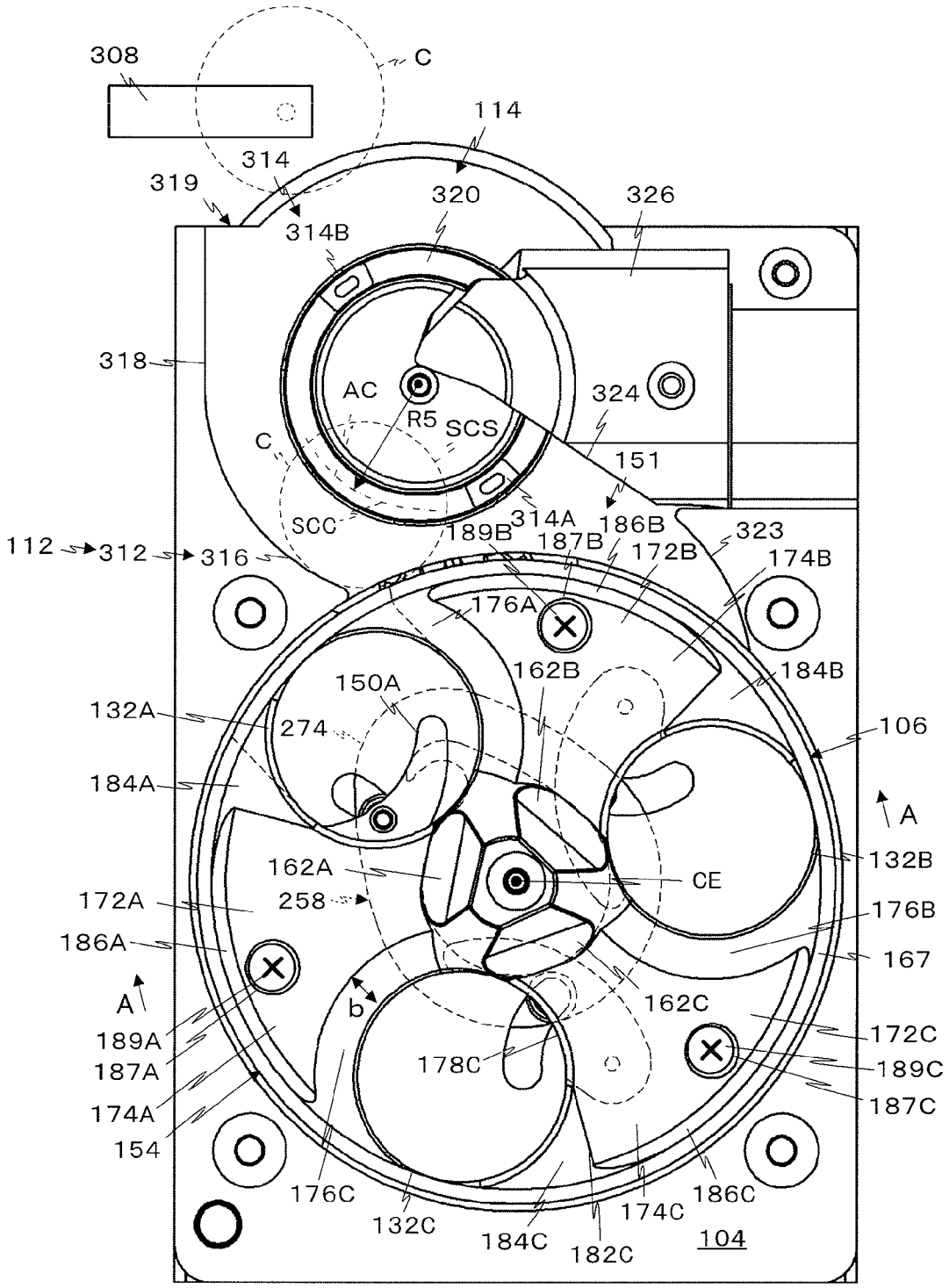
FIG. 2 is a plan view of a state in which a storing bowl is detached from the coin hopper of FIG. 1.
Figure 3:
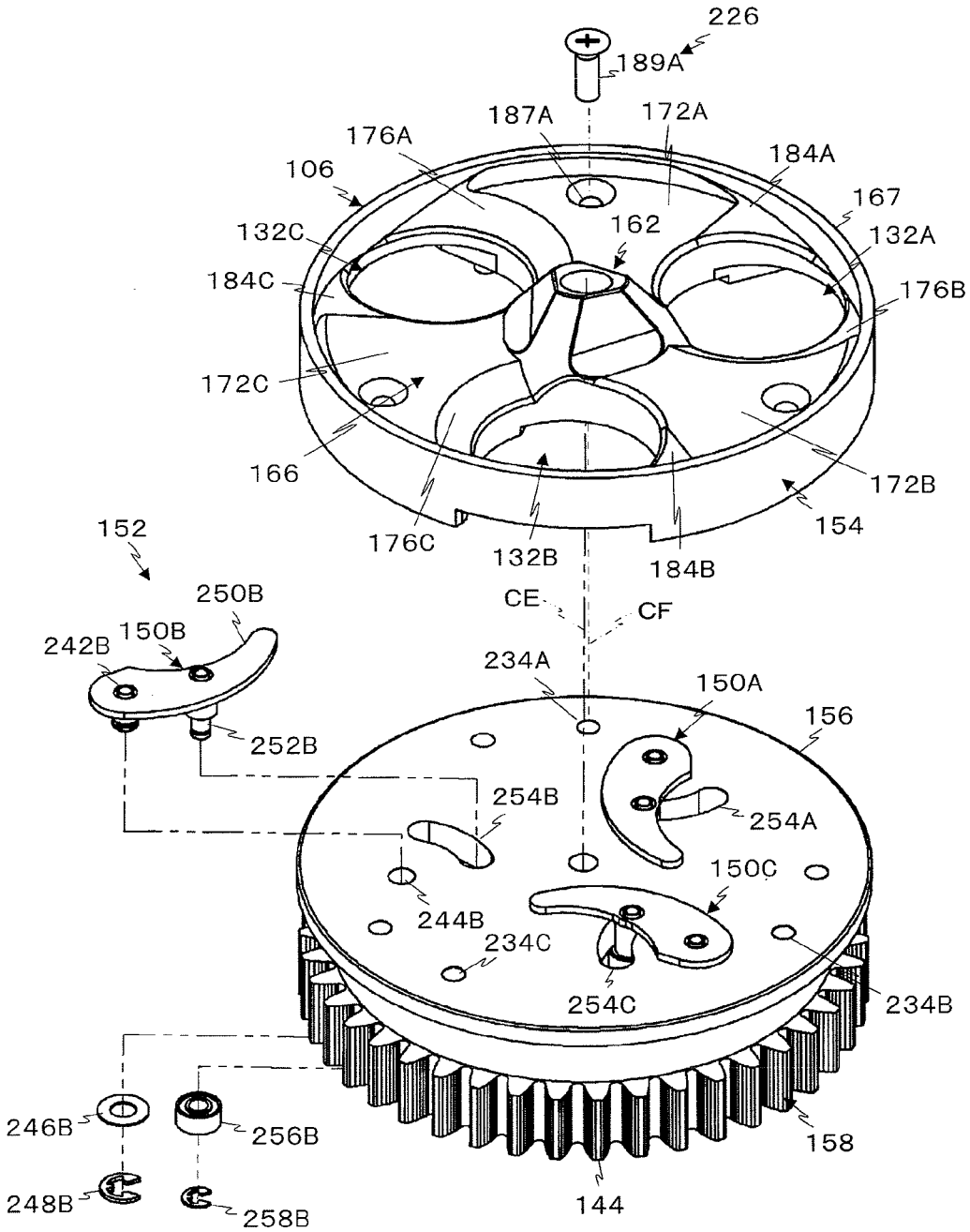
FIG. 3 is an exploded perspective view of a rotating disk used in the coin hopper of FIG. 1.
Figure 4:
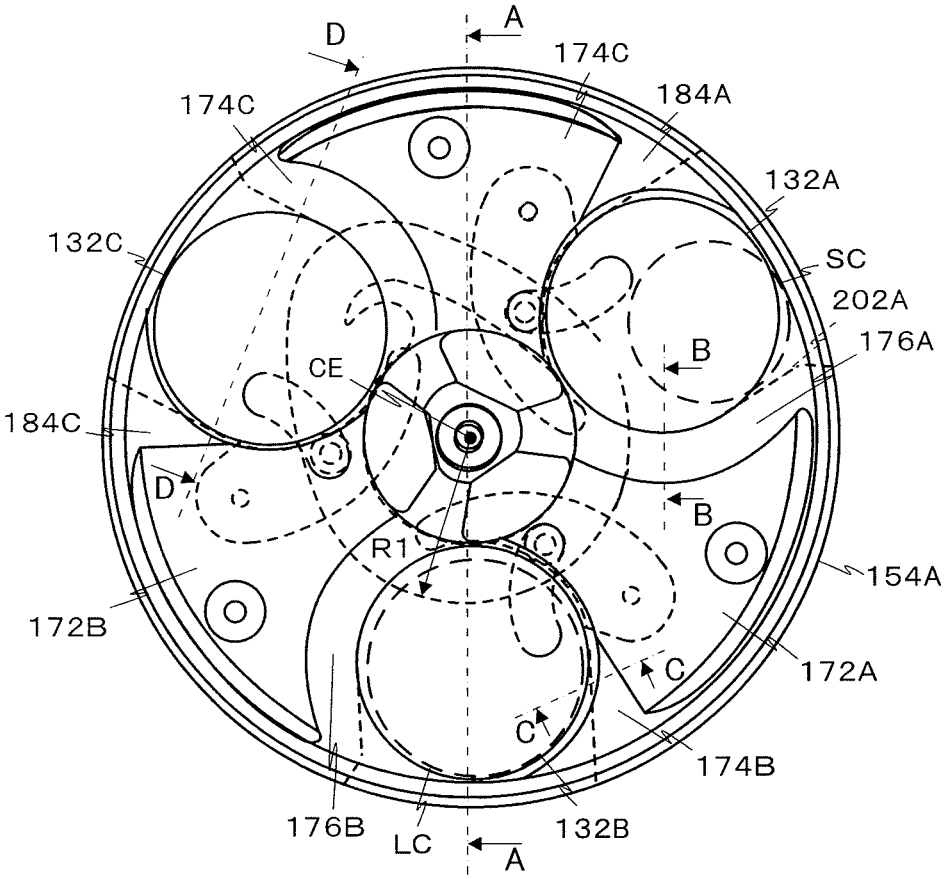
FIG. 4 is a plan view of the rotating disk used in the coin hopper of FIG. 1.

Furthermore, as shown in FIG. 2, with respect to the rotating disk 106, the tip part 274 is arranged to be eccentric to the left side with respect to a perpendicular line passing through the rotating axis CE of the sorting board 154. In other words, the groove cam 264 is formed into an inclined egg shape, which is an egg shape slightly turned counterclockwise about the rotating axis CE.

When the rotating disk 106, i.e., the sorting board 154 is rotated forward, the driving cam 262 is in a fixed state; therefore, the cam followers 256A, 256B, and 256C are guided to the external edge 266 or the internal edge 268 of the groove cam 264 along with rotation of the rotating disk 106, and the pushers 150A, 150B, and 150C are moved to the standby positions SP or the pushing positions PP together with the corresponding cam followers 256A, 256B, and 256C. The positions of the pushers 150A, 150B, and 150C are determined by the positional relations between the supporting shafts 242A, 242B, and 242C and the cam followers 256A, 256B, and 256C. More specifically, when the cam followers 256A, 256B, and 256C are positioned at positions significantly closer to the rotating axis CE than the supporting shaft 242 is, the pushers 150A, 150B, and 150C are relatively turned clockwise about the supporting shaft 242, the pushing edges 250A, 250B, and 250C of the pushers 150A, 150B, and 150C are positioned at a position close to the rotating axis CE. When the pusher 150 is moved from this position in the circumferential direction of the sorting board 154, the pusher is turned counterclockwise about the supporting shaft 242, and the pushing edges 250A, 250B, and 250C are separated from the rotating axis CE and is moved to the coin holding space 206.

The cam followers 256A, 256B, and 256C are preferred to be biased to the internal edge 268 side, specifically, to the internal edge 268 side at least in the return connection part 278. The biasing means can be arbitrarily selected from a spring, weight, etc., but is preferred to be a structure using the gravity, i.e., the weight of the structure because of cost. If the gravity is used, the attachment base 104 has to be inclined to configure that a moment works so as to move the cam followers to get closer to the internal edge 268 about the supporting shafts 242A, 242B, and 242C by the weight of the pushers 150A, 150B, and 150C, the cam followers 256A, 256B, and 256C, etc. In the present first embodiment, the attachment base 104 is horizontally arranged; therefore, the cam followers 256A, 256B, and 256C are biased so as to move to the internal edge 268 side by a spring or the like.

Therefore, when the rotating disk 106 is rotated forward (counterclockwise in FIG. 2), the pushers 150A, 150B, and 150C are integrally rotated counterclockwise together with the sorting board 154. When the cam follower 256A, 256B, or 256C is positioned at the base part 272 of the groove cam 264, the cam follower is guided by the base external edge 282 having the first radius R1 or the base internal edge 292 having the third radius R3 having the same distance from the rotating axis CE; therefore, a constant positional relation with respect to the sorting board 154, therefore, to the through holes 132A, 132B, and 132C is also maintained.

Thus, at the base part 272, the pushers 150A, 150B, and 150C are held at the standby positions SP, and each of the pushers 150A, 150B, and 150C is positioned to be hidden below the sorting board 154 with respect to the coin C in the storing chamber 130.

More specifically, when the cam followers 256A, 256B, and 256C are guided by the base part 272, the positions of the supporting shafts 242A, 242B, and 242C and the cam followers 256A, 256B, and 256C are determined so that the pushers 150A, 150B, and 150C are positioned at the standby position SP. In other words, the cam followers 256A, 256B, and 256C are guided by the base part 272, which is concentric to the rotating axis CE of the sorting board 154; therefore, the pushers 150A, 150B, and 150C continue the standby positions SP (for example, the pushers 150B and 150C in FIG. 11).

Figure 11:
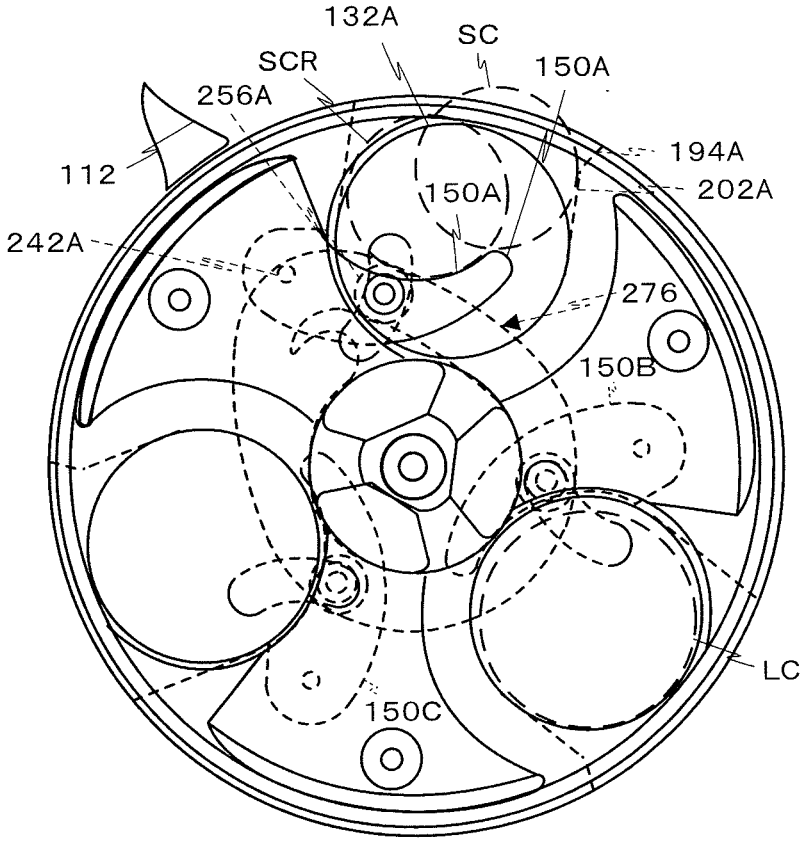
FIG. 11 is a working-explaining front view of the rotating disk used in the coin hopper of FIG. 1 (during pushing).

When the cam followers 256A, 256B, and 256C are moved to the pushing connection part 276, the cam followers 256A, 256B, and 256C are moved in the circumferential direction of the sorting board 154; therefore, the pushers 150A, 150B, and 150C are turned counterclockwise about the supporting shafts 242A, 242B, and 242C and are moved toward the pushing positions PP, thereby pushing out the coins C held in the coin holding space 206 to the circumferential-direction passages 192A, 192B, and 192C while the pushers 150A, 150B, and 150C move to the coin holding space 206 below the through holes 132A, 132B, and 132C (for example, the pusher 150A in FIG. 11).

Figure 12:
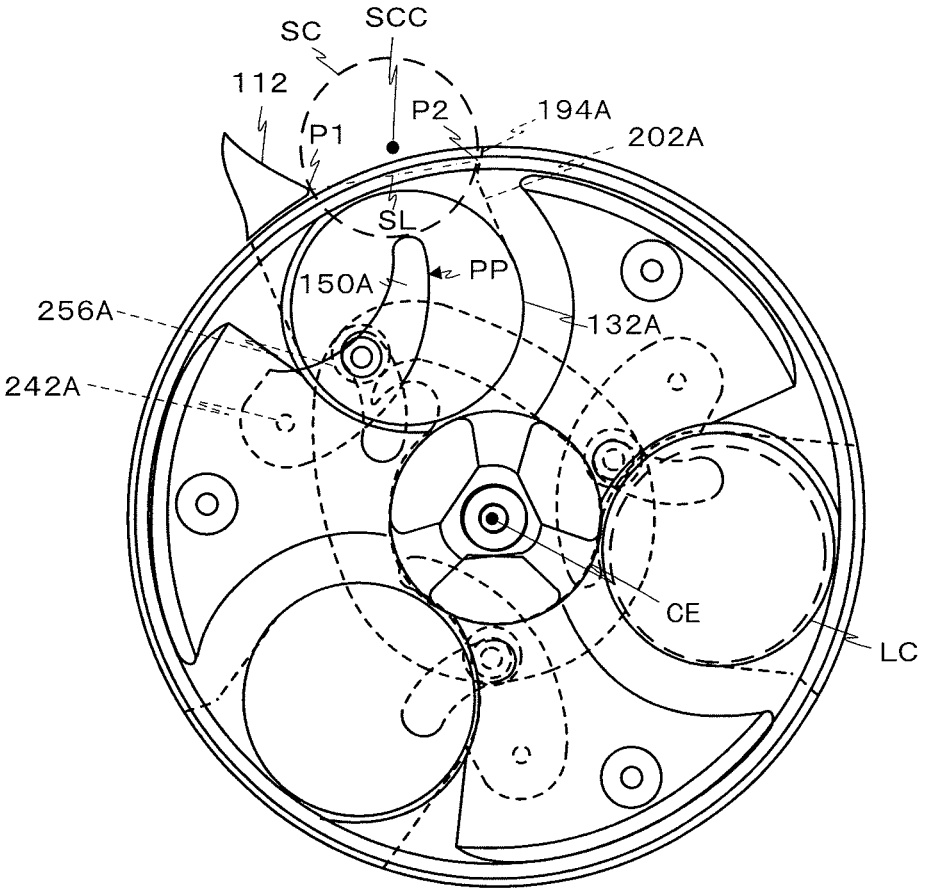
FIG. 12 is a working-explaining front view of the rotating disk used in the coin hopper of FIG. 1 (pushing finished).

When the cam followers 256A, 256B, and 256C are positioned at the tip part 274, the pushers 150A, 150B, and 150C are maximally turned counterclockwise, and the coin C is moved to the pushing position PP. As shown in FIG. 12, the pushing position PP is, for example, moved to the center of the through hole 132A, and the pushing edge 250A is positioned in the outer circumferential edge side of the sorting board 154 with respect to the center of the through hole 132A. In this case, even in the case of the minimum diameter coin SC, if the coin is sandwiched between the coin receiver 112 and the pusher 194A, the coin center SCC of the minimum diameter coin SC is set so as to be positioned at a position more distant from the rotating axis CE than a first straight line SL, which connects a contact point P1 of the coin receiver 112 and the coin C and a contact point P2 of the pusher 194 and the coin C, is. The position of the coin center SCC is preferred to be distant from the rotating axis CE as much as possible.

Figure 13:
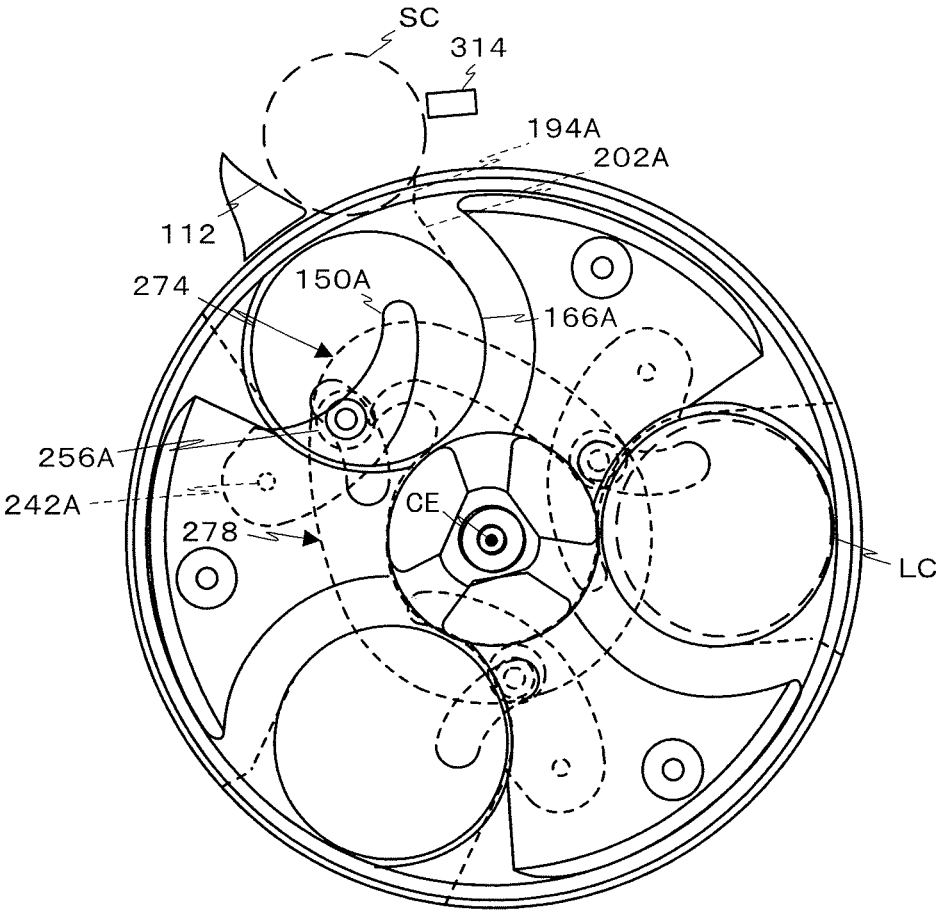
FIG. 13 is a working-explaining front view of the rotating disk used in the coin hopper of FIG. 1 (during pull-back).

As shown in FIG. 13, when the cam follower 256A reaches the return connection part 278, the distance from the rotating axis CE is gradually shortened; therefore, the pusher 150A is turned clockwise about the supporting shaft 242A in FIG. 2, in other words, is moved toward the standby position SP, and the pusher is positioned at the standby position SP when the pusher 150A reaches the base part 272.

The driving cam 262 according to the present invention further includes a backward-rotation standby-position holding cam 300.

The backward-rotation standby-position holding cam 300 has a function to hold the pushers 150A, 150B, and 150C at the standby positions SP so that the pushers are not moved from the standby positions SP or from the vicinities thereof toward the pushing positions PP when the sorting board 154 is rotated backward. The standby position SP referred to herein includes cases having working/effects that are equivalent to those of the case in which the pusher is practically positioned at the standby position SP. In other words, even if the pushing edges 250A, 250B, and 250C are moved to the coin holding space 206 and positioned below the through holes 132, as long as this case has equivalent working/effects, this case is included in the range in which it is held at the standby position SP.

In the present first embodiment, the backward-rotation standby-position holding cam 300 is a backward-rotation groove cam 302, wherein a backward-rotation internal edge 304 is formed by extending the return connection part 278 side of the base internal edge 292 of the base part 272, in other words, the left side of the rotating axis CE in FIG. 10 further by a quarter circumference by a radius that is same as the third radius R3, and, as a result, approximately three-quarter circumference of the internal base edge 292 is formed by the third radius R3 as a whole. With respect to the base internal edge 292, a backward-rotation outer edge 305 is formed to be slightly distant from the diameter of the cam follower 256. Therefore, the backward-rotation groove cam 302 is formed at a position close to the rotating axis CE than from the tip internal edge 294, more specifically, so that the backward-rotation groove cam 302 is formed to dig into the right side from the left side at the tip part 274 as shown in FIG. 10. As a result, the internal edge 268 as a whole has a comma-shape having a circular lower part and a hook-shaped tip part. Therefore, the driving cam 262 has an egg-shaped oval link shape as a whole defined by the egg-shaped external edge 266 and the internal edge 268 having the comma-shape. The driving cam 262 has a shape having an end 306 projecting in a sickle shape from the pushing connection part 276 side of the tip part 274 toward the return connection part 278, in other words, from the right side toward the left side in FIG. 10.

Furthermore, the driving cam 262 has an egg shape, and a symmetrical axis SL2 thereof is turned counterclockwise by about 30 degrees with respect to a vertical line in FIG. 10 and is arranged in a fixed state.

The inclination of the driving cam 262 is turned in this manner because of the relation with the arrangement with the coin receiver 112, and it is preferred to have an inclination of this degree in consideration of movement of the coins C. However, the arrangement is not limited thereto.

Figure 17:
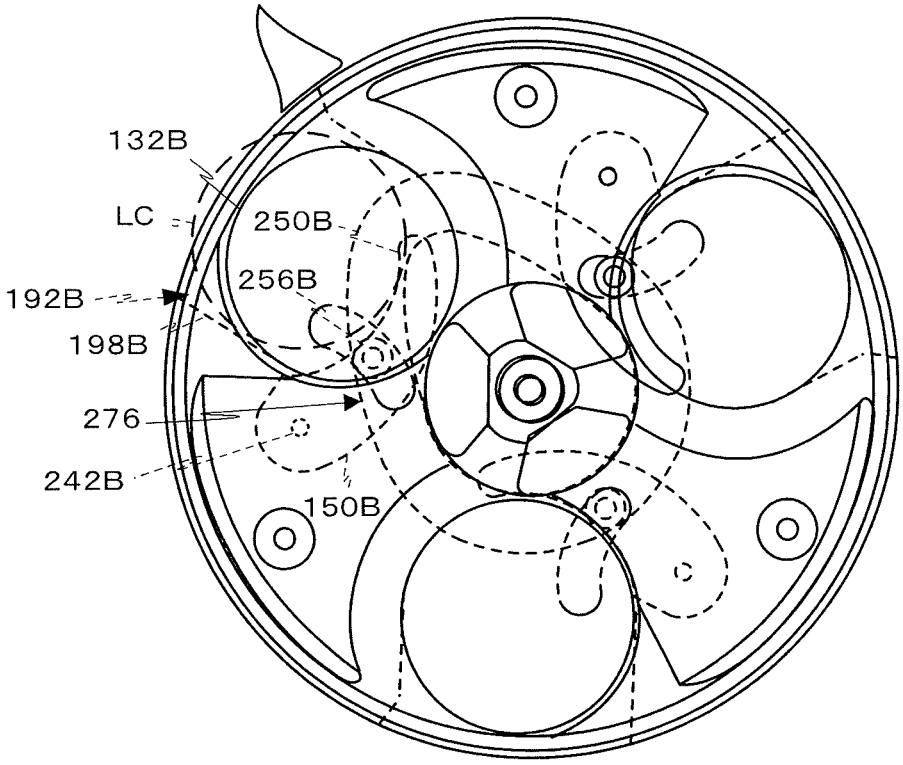
FIG. 17 is a working-explaining front view of the rotating disk used in the coin hopper of FIG. 1 (problem of backward rotation).

The backward-rotation groove cam 302 functions when the sorting board 154 is rotated backward. More specifically, when the sorting board 154 is rotated backward, the cam followers 256A, 256B, and 256C positioned in the return connection part 278 side of the base part 272, i.e., between the left side of the rotating axis CE in FIG. 10 and the end 306 of the backward-rotation groove cam 302 can be moved to the end 306 of the backward-rotation groove cam 302 along the internal edge 268 specifically while being guided by the backward-rotation internal edge 304. The backward-rotation internal edge 304 is formed by the third radius R3, which is the same as that of the base internal edge 292; therefore, since the pushers 150A, 150B, and 150C are held at the standby positions SP, the coin C is not moved to the circumferential-direction passage 192B for example as shown in FIG. 17 even if the coin C is positioned in the coin holding space 206. In other words, the coin C is not moved in the circumferential direction and pushed against the outer circumferential edge, the sorting board 154 can be rotated backward in the range in which the backward-rotation groove cam 302 is present.

Next, the driver 108 of the rotating disk 106 will be explained mainly with reference to FIG. 6.

The driver 108 has a function to rotate the rotating disk 106, therefore, the sorting board 154 and the coin holding plate 156 forward or backward at a specified speed.

In the present first embodiment, the driver 108 includes the electric motor 148 and the decelerator 219.

The decelerator 219 is fixed to the back side of the attachment base 104, and the rotating shaft 189 serving as an output shaft thereof is arranged and projected to the upper side so that the axis thereof matches the rotating axis CE of the base part 272 of the groove cam 264, and the rotating disk 106 is fixed to the tip part thereof in the above described manner.

Next, the coin receiver 112 of the coins will be explained mainly with reference to FIG. 2.

The coin receiver 112 has a function to guide the coins C, which are sorted and fed one by one by the sorting board 154, in the circumferential direction of the sorting board 154 (the rotating disk 106).

In the present first embodiment, the coin receiver 112 is a first guiding edge 312 comprised of a first step, which forms the outlet groove 151. The first guiding edge 312 is extending so as to get away from the storage hole 146 in the circumferential direction of the sorting board 154. In the present first embodiment, the first guiding edge 312 includes a circular-arc part 316, which has a specified radius about a second rotating axis RC of pushing pieces 314, and a straight part 318, which is continued to the circular-arc part 316. The circular-arc part 316 has a function to extend approximately in the normal-line direction with respect to the storage hole 146 and then guide the coins while gradually changing the direction approximately by 45 degrees. The straight part 318 has a function to extend linearly from the terminal of the circular-arc part 316 and linearly guide the coins in the direction that gets away from the sorting board 154.

Next, a coin sensor 308 of the coin hopper 100 will be explained.

The coin sensor 308 has a function to detect the coins C fed from an outlet 319 and output coin detection signals CDS to a higher-level control circuit 344 and can employ a publicly known photoelectric sensor, magnetic sensor, mechanical sensor, or the like.

In the present first embodiment, the coin sensor 308 is a transmissive photoelectric sensor and is fixed to the attachment base 104 by a bracket, which is not shown.

Next, the pushing pieces 314 will be explained mainly with reference to FIG. 2.

The pushing pieces 314 have a function to move the coin C, which has been pushed out by the pusher 150, along the circular-arc part 316 and the straight part 318 and feed the coin from the outlet 319. In other words, the pushing piece 314 functions as the carrier 114 of the coins C.

Specifically, the pushing pieces 314 have a function to be rotated together with the rotating disk 106, push the coin C, which has moved to the outlet groove 151 through the circumferential-direction passage 192 by the pusher 150, and move the coin along the circular-arc part 316 and the straight part 318. In the present first embodiment, the pushing pieces 314 include two pushing pieces 314A and 314B, which are arranged symmetrically about a point with respect to the second rotating axis RC, and the sorting board 154 has three through holes 132A, 132B, and 132C; therefore, the pushing pieces are rotated at a rotating speed that is 1.5 times with respect to that of the rotating disk 106. In other words, while the rotating disk 106 is rotated twice, the pushing pieces 314A and 314B are rotated three times, and, as a result, the coins C fed from the through holes 132A, 132B, and 132C one by one are moved along the coin receiver 112 by pushing the coins while the coins are pushed against the coin receiver 112 one by one by the pushing piece 314A or 314B.

The pushing piece 314 is a small piece projecting upward from the upper surface of a disk 320, which rotates about the second rotating axis RC, and formed in an arc shape about the second rotating axis RC, and the pushing piece projects from the bottom surface of the outlet groove 151 by a specified height. The projection distance thereof is formed to be slightly larger than that of the thickest coin C and is approximately the same height as the height of the coin receiver 112.

The disk 320 is concentrically integrated with the moved gear 224 arranged therebelow.

Next, the moved gear 224 will be explained.

The moved gear 224 is meshed with the gear wheel 144 and subjected to rotary drive clockwise in FIG. 1.

The moved gear 224 is rotatably arranged in a disk-shaped space in the attachment base 104, and part thereof is projecting into the storage hole 146 and meshed with the gear wheel 144.

Figure 14:
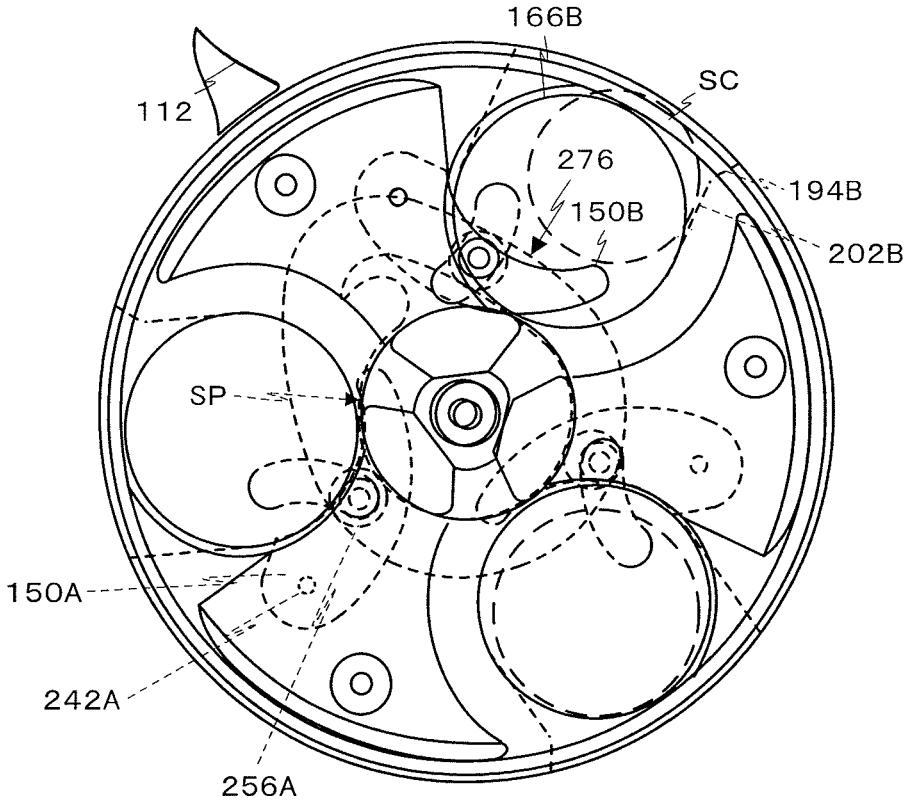
FIG. 14 is a working-explaining front view of the rotating disk used in the coin hopper of FIG. 1 (completely pulled back).

The diameter ratio, i.e., the gear ratio of the gear wheel 144 and the moved gear 224 is 3 to 2. By virtue of this, the three through holes 132A, 132B, and 132C and the two pushing pieces 314A and 314B are configured to have a relation that they are rotated at a specified phase. More specifically, as shown in FIG. 14, timing is set so that immediately after the pusher 150 is positioned at the pushing position PP, the coin C pushed out by the pusher 150 is pushed toward the coin receiver 112.

As shown in FIG. 2, when the pushing piece 314 starts pushing, the pushing piece is set so as to be in contact with the circumferential surface of the coin C at a position slightly close to the second rotating axis RC than a circular arc AC, which employs the second rotating axis RC as a center and employs the distance to the coin center SCC of the minimum diameter coin SC as a fifth radius R5, is. By virtue of this, the pushing piece 314 pushes the circular-arc circumferential surface SCS of the coin C approximately from a direction orthogonal thereto; therefore, it works so that the pressing force with respect to the coin receiver 112 of the minimum diameter coin SC is suppressed low, and there is therefore an advantage that the coin C is smoothly moved.

Next, a second guiding edge 322, which defines a first side of the outlet groove 151, will be explained.

The second guiding edge 322 is comprised of an arc-shaped wall 323 and a straight wall 324, which are integrally formed with the attachment base 104 in the present first embodiment.

The arc-shaped wall 323 has a function to guide the coin C, which has been pushed out by the pusher 150, to move to the pushing piece 314 side. More specifically, the arc-shaped wall forms an arc shape directed from the vicinity of an end of the storage hole 146 in the opposite side of the coin receiver 112 to the circumferential direction of the storage hole 146 and to the coin receiver 112 side.

The straight wall 324 is formed by a first straight side surface of a knife 326, which is separated from the attachment base 104 and has a knife shape, is continued to the arc-shaped wall 323, and is extended to the vicinity of the second rotating axis RC so as to be directed to a straight part 318. Therefore, on the back side of the knife 326, an arc-shaped passage groove (not shown) in which the pushing piece 314 can be moved is formed.

Therefore, in the present first embodiment, as shown in FIG. 2, the outlet groove 151 forms an S-shape as a whole by the first guiding edge 312 and the second guiding edge 322 and has a shape that is continued to the storage hole 146, curved to the left side, and then curved to the right side. Therefore, the coin C is moved to the outlet 319 side by the pushing piece 314 while being guided by the first guiding edge 312 and the second guiding edge 322, is fed out from the outlet 319, and is detected by the coin sensor 308.

Figure 18:
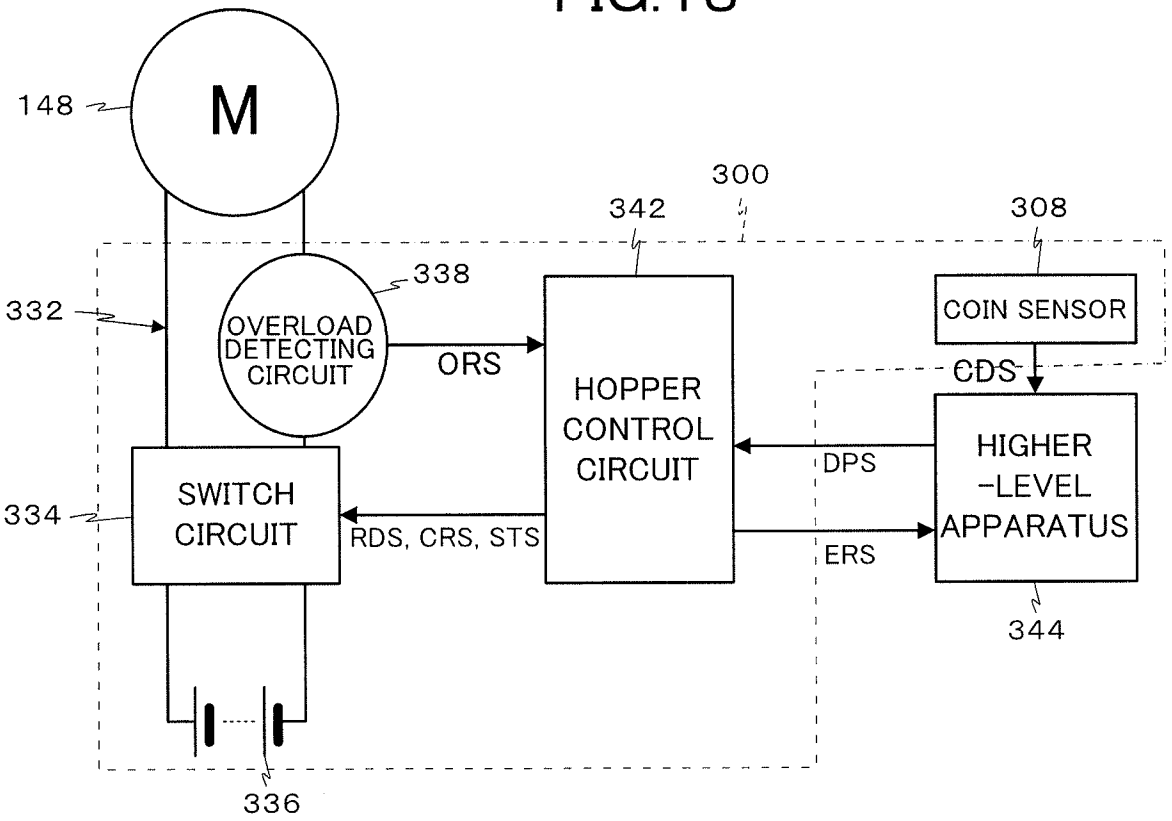
FIG. 18 is a control block diagram of the coin hopper of FIG. 1.

Next, a control circuit 330 of the electric motor 148 will be explained with reference to FIG. 18.

The electric motor 148 is connected to a direct-current power source 336 via a switch circuit 334 inserted in a power feeding circuit 332. An overload detecting circuit 338 is inserted in the power feeding circuit 332 between the switch circuit 334 and the electric motor 148. If an overcurrent is detected, the overload detecting circuit 338 outputs an overload signal ORS to a hopper control circuit 342.

Based on the overload signal ORS from the overload detecting circuit 338 and a dispensing signal DPS, which is one of original control signals from the higher-level control circuit 344 of a higher-level apparatus, the hopper control circuit 342 outputs a forward-rotation signal RDS or a restart signal ARS, a first backward-rotation signal CRS1, a second backward-rotation signal CRS2, a first stop signal STS1, a second stop signal STS2, or a third stop signal STS3 to the switch circuit 334. The hopper control circuit 342 is comprised of, for example, a microprocessor.

When the switch circuit 334 receives the forward-rotation signal RDS or the restart signal ARS, the switching circuit subjects the power feeding circuit 332 of the electric motor 148 to forward rotation connection. When the switching circuit 334 receives the first backward-rotation signal CRS1 or the second backward-rotation signal CRS2, the switching circuits subjects the power feeding circuit 332 to backward rotation connection. When the switching circuit 334 receives the stop signal STS, the first stop signal STS1, the second stop signal STS2, or the third stop signal STS3, the switching circuit 334 opens the circuit.

The control circuit 330 is fixed to, for example, the back side of the attachment base 104.

Next, the higher-level control circuit 344 will be explained.

The higher-level control circuit 344 controls the higher-level apparatus and, in addition, has a function to output the dispensing signal DPS to the hopper control circuit 342, counts the coin detection signal CDS from the coin sensor 308, and, if the counted value is a specified value and based on an error signal ERS from the hopper control circuit 342, stop output of the dispensing signal DPS to the hopper control circuit 342.

The higher-level control circuit 344 is comprised of, for example, a microprocessor.

Figure 19:
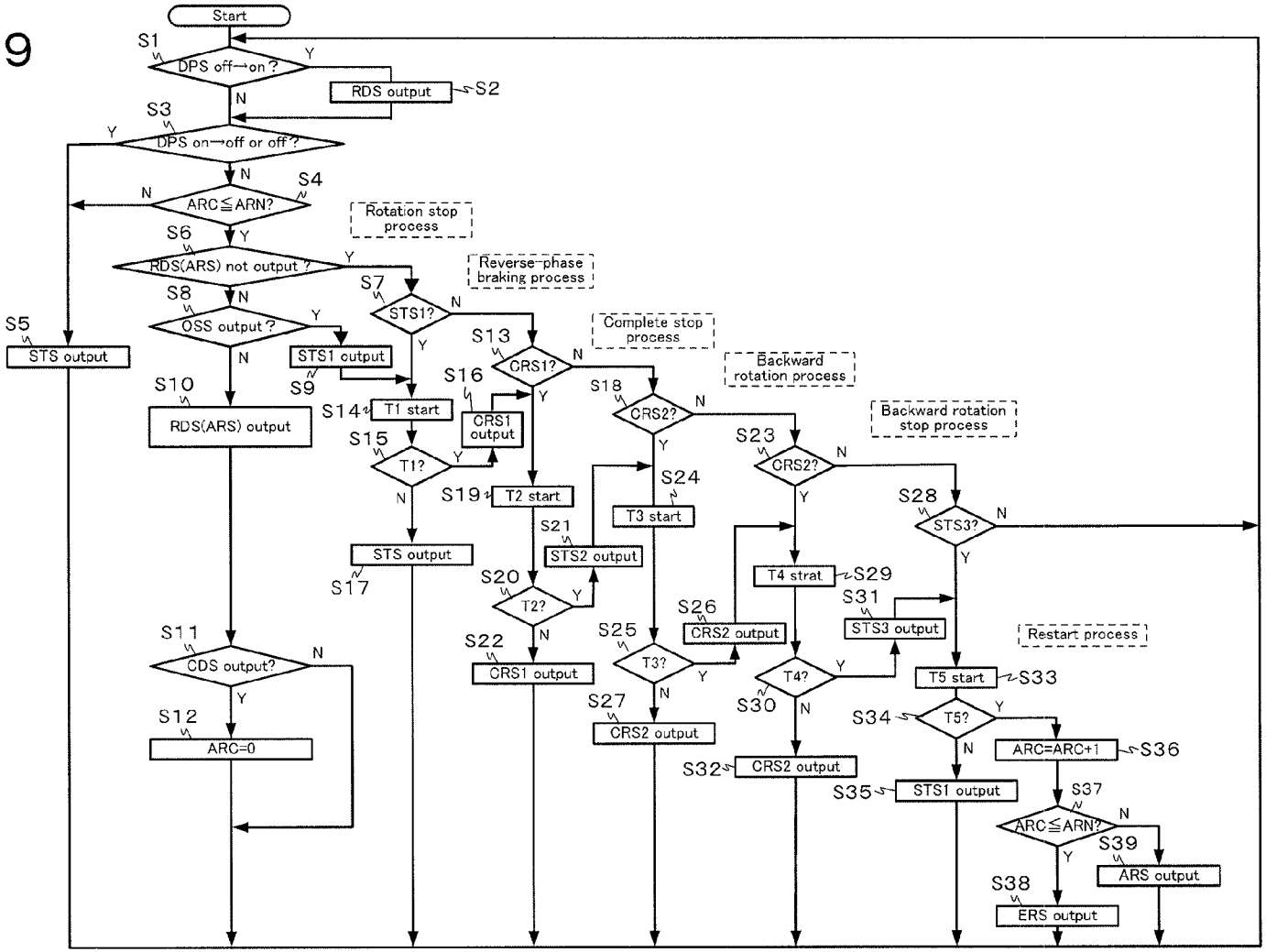
FIG. 19 is a control flow chart of the coin hopper of FIG. 1.

Next, working of the hopper control circuit 342 will be explained with reference to the flow chart of FIG. 19. In the below explanation, suffixes A, B, and C will be omitted in the explanation except for the case in which any of the three through holes 132A, 132B, and 132C; the three pushers 150A, 150B, and 150C; the three cam followers 256A, 256B, and 256C; and the three supporting shafts 242A, 242B, and 242C has to be specified.

First, normal working (coin feeding) will be explained.

When the coins C are to be fed out, the higher-level control circuit 344 outputs the dispensing signal DPS (see FIG. 20) to the hopper control circuit 342.

In step S1, the hopper control circuit 342 determines whether the dispensing signal DPS has been changed from off to on. If the dispensing signal DPS has been changed from off to on, the process proceeds to step S2. If the dispensing signal DPS has been changed from on to off or continues being off, the process proceeds to step S3. Therefore, step S1 determines a dispensing instruction from the higher-level control circuit 344.

In step S2, the hopper control circuit 342 outputs the forward-rotation signal RDS and proceeds to step S3.

The switch circuit 334, which has received the forward-rotation signal RDS, subjects the power feeding circuit 332 to forward-rotation connection. Therefore, the electric motor 148 is rotated forward, the rotating disk 106 is rotated counterclockwise in FIG. 2 as a result at a specified speed, and the coins C are fed to the outlet groove 151 one by one in the above described manner, pushed by the pushing piece 314A or 314B, is moved along the coin receiver 112, is finally fed out from the outlet 319, and is detected by the coin sensor 308. The coin sensor 308 outputs the coin detection signal CDS to the higher-level control circuit 344 by detection of the coin C.

In step S3, whether the dispensing signal DPS has been changed from onto off or has still been Off is determined. If it has not been changed to Off or has still been Off, the process proceeds to step S4. If the dispensing signal has been changed to Off, the process proceeds to step S5. Therefore, step S3 determines elimination of the dispensing instruction.

In step S4, if a restart number is within a permission number ARN or not is determined. If it exceeds the permission number ARN, the process proceeds to step S5 since restart cannot be carried out. If it is within the permission number ARN, the process proceeds to step S6. Therefore, in step S4, whether restart can be carried out or not is determined.

In step S5, the hopper control circuit 342 outputs the stop signal STS and then returns to step S1.

Based on the stop signal STS, the switch circuit 334 continues to open the circuit, and the electric motor 148, therefore, the rotating disk 106 continues a still state. Therefore, while the dispensing signal DPS is not output, steps S1, S3 or S4, and S5 are looped, in other words, the rotating disk 106 continues stopping.

In step S6, whether a signal other than the forward-rotation signal RDS or the restart signal ARS, i.e., the stop signal STS, the first stop signal STS1, the first backward-rotation signal CRS1, the second stop signal STS2, the second backward-rotation signal CRS2, or the third stop signal STS3 is output or not is determined. If this is output and in a case of no signal, the process proceeds to step S7. If none of them is not output, i.e., in a case in which the forward-rotation signal RDS (and the restart signal ARS) is output, the process proceeds to step S8. Therefore, step S6 determines a forward-rotation instruction.

In step S8, whether an overload stop signal OSS is output or not is determined. If output, the process proceeds to step S9. If not output, the process proceeds to step S10. Therefore, in step S8, overload stop is determined. If the overload stop signal OSS is determined, this is a starting point to carryout a rotation stop process, a reverse-phase braking process, a complete stop process, a backward-rotation process, a backward-rotation stop process, and a restart process described later.

The overload stop signal OSS is output in corresponding with the overload signal ORS from the overload detecting circuit 338. For example, in the process of dispensing the coins C, sometimes, so-called coin jamming in which the coins C serve as obstructing sticks between the sorting board 154 and the storing bowl 102 occurs, and the rotating disk 106 stops rotating. In that case, the electric motor 148 tries to continue rotation; therefore, an overcurrent exceeding a specified value flows to the power feeding circuit 332, and the overload detecting circuit 338 outputs the overload signal ORS. If it is determined that this overload signal ORS has been continued for specified time OT (FIG. 20), the hopper control device 342 outputs the overload stop signal OSS.

In step S10, the hopper control circuit 342 outputs the forward-rotation signal RDS to the switch circuit 334, then executes step S12 after step S11, and then returns to step S1.

In step S11, presence of the coin detection signal CDS from the coin sensor 308 is determined. If the coin detection signal CDS is detected, the process proceeds to step S12. If not detected, the process returns to step S1. The fact that the coin detection signal CDS is output from the coin sensor 308 means that the coin jamming has been eliminated. Therefore, step S11 determines elimination of coin jamming.

In step S12, the restart number calculated and stored in step S37 is reset to zero.

Therefore, the flow of steps S1 to S4, S6, S8, S10, S11, and S12 is a normal dispensing state of the coins C.

Therefore, while: the dispensing signal DPS is output, the restart number is within the permission number ARN, the forward-rotation signal RDS is output, and the overload signal ORS is not output, steps S1, S3, S4, S6, S8, S10, S11, and S12 are looped; in other words, the rotating disk 106 continues forward rotation. While this forward rotation is continued, the higher-level control circuit 344 counts the coin detection signals CDS, compares that with a dispensing set value determined by itself, and, if matched, outputs a stop signal to the hopper control circuit 342. Thus, the dispensing signal DPS is turned from on to off since output of the dispensing signal DPS is stopped; therefore, it is determined in step S3, and the process proceeds to step S5. For example, when the dispensing set value is set to 10, output of the dispensing signal DPS is continued until ten coin detection signals CDS from the coin sensor 308 are received; and, when reception of the ten signals is determined, output of the dispensing signal DPS is stopped.

If output of the dispensing signal DPS is stopped, the process proceeds from step S3 to step S5, and the hopper control circuit 342 outputs the stop signal STS to the switch circuit 334. The switch circuit 334 opens the circuit of the power feeding circuit 332 by the stop signal STS; therefore, the electric motor 148, therefore, the rotating disk 106 stops after inertial rotation, and dispensing of the coins C is stopped.

Next, the rotation stop process will be explained.

In step S7, whether the first stop signal STS1 is present or not is determined. If the first stop signal STS1 is not present, the process proceeds to step S13. If present, the process proceeds to step S14.

In step S9, the first stop signal STS1 is output, and, then, the process proceeds to step S14.

Since the switch circuit 334 opens the circuit of the power feeding circuit 332 based on the first stop signal STS1, the electric motor 148, therefore, the rotating disk 106 is rotated by inertia and stops still in the end.

In step S14, measuring of first measured time T1 is started, and the process then proceeds to step S15.

In step S15, whether the first measured time T1 has elapsed or not is determined. If elapsed, the process proceeds to step S16. If not elapsed, the process proceeds to step S17. The first measured time T1 is an idling period until reverse-phase braking works after the circuit of the power feeding circuit 332 is opened; therefore, the time may be an extremely short period of time. Therefore, the first stop signal STS1 is a signal, which serves as a starting point of the rotation stop process of the rotating disk 106.

In step S16, after the first backward-rotation signal CRS1 is output to the switch circuit 334, the process proceeds to step S19.

In step S17, the first stop signal STS1 is output to the switch circuit 334, and the process returns to step S1. Thus, while the first stop signal STS1 is output, steps S1, S3, S4, S6, S7, S14, S15, and S17 are looped, and the switch circuit 334 opens the circuit of the power feeding circuit 328. Therefore, the electric motor 148, therefore, the rotating disk 106 is subjected to inertial rotation.

Next, the reverse-phase braking process will be explained.

In step S13, whether the first backward-rotation signal CRS1 is output or not is determined. If not output, the process proceeds to step S18. If output, the process proceeds to step S19.

In step S19, after measuring of second measured time T2 is started, the process proceeds to step S20.

In step S20, whether the second measured time T2 has been measured or not is determined. If measuring of the time is determined, the process proceeds to step S21. If measuring of the time is not determined, the process proceeds to step S22.

In step S22, the first backward-rotation signal CRS1 is output, and the process returns to step S1. Therefore, while: the dispensing signal DPS is output, the restart number is within the permission number ARN, and the first backward-rotation signal CRS1 is output, steps S1, S3, S4, S6, S7, S13, S19, S20, and S22 are looped. In other words, during the second measured time T2, backward rotation torque works on the electric motor 148, therefore, on the rotating disk 106. Since the reverse-phase braking for rapidly stopping the electric motor 148 and the rotating disk 106, which are rotated by inertial force, works, the second measured time T2 is only required to continue until the rotating disk 106 becomes an approximately stopped state. Therefore, the first backward-rotation signal CRS1 is a signal serving as a starting point of the reverse-phase braking process. The second measured time T2 is preferred to be about ten times the first measured time T1.

Next, the complete stop process will be explained.

In step S18, whether the second stop signal STS2 is output or not is determined. If not output, the process proceeds to step S23. If output, the process proceeds to step S24.

In step S24, measuring of third measured time T3 is started, and the process proceeds to step S25.

In step S25, whether it has reached the third measured time T3 or not is determined. If it has reached the third measured time T3, the process proceeds to step S26. If it has not reached T3, the process proceeds to step S27.

In step S27, the second stop signal STS2 is output, and the process returns to step S1. In other words, if the second stop signal STS2 is output, steps S1, S3, S4, S6, S7, S13, and S18; or S8, S9, S14, S15, S16, S19, S20, and S22; and S24, S25, and S27 are looped.

Since the switch circuit 334 opens the circuit of the power feeding circuit 332 based on the second stop signal STS2, drive torque does not work on the electric motor 148, therefore, on the rotating disk 106, and the rotating disk 106 immediately becomes a stopped state in combination with application of the above described backward-rotation torque.

Next, the backward-rotation process will be explained.

In step S23, whether the second backward-rotation signal CRS2 is output or not is determined. If the second backward-rotation signal CRS2 is not output, the process proceeds to step S28. If CRS2 is output, the process proceeds to step S29. Therefore, the second stop signal STS2 is a signal serving as a starting point of the complete stop process of the rotating disk 106.

In step S29, measuring of fourth measured time T4 is started, and the process proceeds to step S30.

In step S30, whether it has reached the fourth measured time T4 or not is determined. If it has reached the fourth measured time T4, the process proceeds to step S31. If it has not reached T4, the process proceeds to step S32.

In step S32, the second backward-rotation signal CRS2 is output, and the process returns to step S1. In other words, while the second backward-rotation signal CRS2 is output, steps S1, S3, S4, S6, S7, S13, S18, and S23; or S8, S9, S14, S15, S16, S19, S20, and S21; and S24, S25, S26, S29, S30, and S32 are looped.

Based on the second backward-rotation signal CRS2, the switch circuit 334 subjects the power feeding circuit 332 to backward rotation connection. Therefore, backward rotation torque works on the electric motor 148, therefore, the rotating disk 106. In other words, when the second backward-rotation signal CRS2 is output, the electric motor 148, therefore, the rotating disk 106 is rotated backward until the fourth measured time T4 is measured, or, when the cam follower 256 is abutting the end 306 of the backward-rotation groove cam 302, the still state is continued. Therefore, the fourth measured time T4 has a function for setting backward-rotation time of the rotating disk 106, and the second backward-rotation signal is a signal serving as a starting point of the backward-rotation process, in which the rotating disk 106 is rotated backward.

The fourth measured time T4 in step S29 is preferred to have a length equivalent to the second measured time T2. As described later, this is for preventing the overload stop signal OSS from being output upon backward rotation.

Therefore, the fourth measured time T4 is set to the longest time in which the rotating disk 106 can be rotated backward. In other words, the fourth measured time T4 is set to the time that does not exceed the specified time OT in which the overload signal ORS output by the overload detecting circuit 338 outputs the overload stop signal OSS even when the electric motor 148 is overloaded as a result of prevention of backward rotation by the end 306 of the backward-rotation groove cam 302 in the shortest time when the cam follower 256 is rotated backward. Further in other words, backward rotation of the electric motor 148 according to the fourth measured time T4 does not cause the hopper control circuit 342 to output the stop signal STS. Therefore, the fourth measured time T4 is backward-rotation time CR for eliminating the coin jamming of the rotating disk 106, therefore, the sorting board 154.

By virtue of this backward rotation, the cam follower 256 moves the groove cam 264 in the direction opposite to the forward-rotation direction. More specifically, since the cam follower 256 is moved clockwise in FIG. 10, the cam follower 256 positioned at the return connection part 278 is moved in the backward-rotation groove cam 302 along the backward-rotation internal edge 304.

As shown in FIG. 17, if there is no backward-rotation groove cam 302, the cam follower 256 is reversely moved in the return connection part 278 and is moved in the direction that gets away from the rotating axis CE; therefore, there is a problem of occurrence of coin jamming, wherein the pusher 150 is moved in the circumferential direction of the sorting board 154, the coin C positioned in the coin holding space 206 is pushed against the circumferential wall of the storage hole 146 while being pushed by the front side guide 198, and the rotating disk 106 stops rotating.

However, the backward-rotation internal edge 304 of the backward-rotation groove cam 302 is a circular arc that employs the rotating axis CE as a center and has the same radius as that of the base internal edge 292 of the base part 272; therefore, the pusher 150 continues the standby position SP. Therefore, even when the coin C is stored in the coin holding space 206, the coin is smoothly rotated backward without being moved in the circumferential direction of the sorting board 154 by the pusher 150 and pushed against the circumferential wall of the storage hole 146. Then, when the cam follower 256 abuts the end 306 of the backward-rotation groove cam 302, the electric motor 148 becomes an overloaded state. However, since the backward-rotation time CR, therefore, the fourth measured time T4 is short time, the hopper control circuit 342 does not output the overload stop signal OSS although the overload detecting circuit 338 outputs the overload signal ORS.

Next, the backward-rotation stop process will be explained.

In step S28, whether the third stop signal STS3 is output or not is determined. If STS3 is not output, the process returns to step S1. If STS3 is output, the process proceeds to step S33.

In step S33, after measuring of fifth measured time T5 is started, the process proceeds to step S34.

In step S34, measuring of the fifth measured time T5 is determined. If it has reached T5, the process proceeds to step S36. If it has not reached T5, the process proceeds to step S35.

In step S35, after the third stop signal STS3 is output, the process returns to step S1. Since the switch circuit 334 opens the circuit of the power feeding circuit 332 based on the third stop signal STS3, the electric motor 148, therefore, the rotating disk 106 is rotated backward by inertia and is then stopped still in the end.

More specifically, when the third stop signal ST3 is output, steps S1, S3, S4, S6, S7, S13, S18, S23, and S28; or S8, S9, S14, S15, S16, S19, S20, S21, S24, S25, S26, S29, S30, S31, S33, S34, and S35 are looped. In other words, until the fifth measured time T5 elapses, the third stop signal STS3 is output. The fifth measured time T5 is the time sufficient for stopping the rotating disk 106, which is rotated by inertia, still. Therefore, the third stop signal STS3 is a signal serving as a starting point of the backward-rotation stop process for stopping the backward rotation of the rotating disk 106.

Next, the restart process will be explained.

In step S36, after the permission number ARN of automatic restart is increased by "1" and stored in a storage device, the process proceeds to step S37.

In step S37, whether an automatic restart number is within the permission number ARN or not is determined. If the number exceeds the permission number ARN, the process proceeds to step S38. If the number is within the permission number ARN, the process proceeds to step S39.

In step S38, after the error signal ERS is output to the higher-level control circuit 344, the process returns to step S1.

In step S39, the forward-rotation signal RDS is output, and the process returns to step S1. Since the switch circuit 334 subjects the power feeding circuit 332 to forward-rotation connection by this forward-rotation signal RDS, the electric motor 148, therefore, the rotating disk 106 is subjected to forward-rotation start again, and the coins C are fed out one by one in the above described manner. This forward-rotation signal RDS is the restart signal ARS since this signal is executed based on a program in the hopper control circuit 342.

The higher-level control circuit 344 receives the error signal ERS and carries out an error process such as stopping working of all related devices or displaying an error message. For example, a stop instruction is output to the hopper control circuit 342, the dispensing signal DPS is therefore turned from on to off; therefore, the process proceeds from step S3 to S5, and the stop signal STS is output in step S5. According to this stop signal STS, the switch circuit 334 opens the circuit of the power feeding circuit 328. As a result, the electric motor 148, therefore, the rotating disk 106 becomes a still state after it is rotated by inertia.

The process from steps S8 to S39 carries out a process until stop in the case in which the overload stop signal OSS is output, in other words, the overload stop process. Therefore, if the permission number ARN of restart is set to a plural number, this overload stop process is carried out the plural number; for example, if the permission number ARN of restart is set to three, the process is executed three times. In other words, the rotating disk 106 is rotated backward three times to carry out an operation to eliminate coin jamming.

The restart process according to steps S36, S37, and S39 carries out automatic restart of the permission number ARN.

In other words, this is a function to permit limited backward rotation of the rotating disk 106 by the permission number ARN in a case in which the electric motor 148 is overloaded, the overload detecting circuit 338 outputs the overload signal ORS, and the hopper control circuit 342 outputs the overload stop signal OSS.

If the dispensing signal DPS is output in the case in which the process returns to step S1, the process proceeds to step S4 as described above. If the restart number is the permission number ARN of restart, the process proceeds to step S6. Then, if the forward-rotation signal RDS is output, the process proceeds to step S8, wherein whether the overload signal ORS is output or not is determined. If ORS is not output, the process proceeds to step S10, wherein the forward-rotation signal RDS is output.

For example, if coin jamming is eliminated by the first backward rotation of the rotating disk 106, the overload detecting circuit 338 does not output the overload signal ORS since the electric motor 148 is not overloaded. Therefore, while the dispensing signal DPS is output, the rotating disk 106 continues rotation.

If the coin jamming is not eliminated by the first backward rotation of the rotating disk 106, the overload detecting circuit 338 outputs the overload signal ORS by automatic restart based on the restart signal ARS (forward-rotation signal RDS) in step S39. If the output is continued for specified time in a manner similar to above description, the hopper control circuit 342 outputs the overload stop signal OSS. Therefore, the overload stop signal OSS is output in step S8, and, then, the rotation stop process, the reverse-phase braking process, the complete stop process, the backward-rotation process, the backward-rotation stop process, and the restart process are sequentially executed.

In step S36 in the restart process, the restart number ARC is incremented to "2". Therefore, the number is compared with the permission number ARN, which is 3, in step S4, and the process proceeds to step S8 as described above since it is below the permission number ARN.

By virtue of this, as well as the above description, if coin jamming has been eliminated, the forward rotation is continued. If the coin jamming has not been eliminated, as well as the above description, the rotation stop process, the reverse-phase braking process, the complete stop process, the backward-rotation process, the backward-rotation stop process, and the restart process are executed in the above described manner.

Since the permission number ARN is 3 in the present first embodiment, the restart number ARC is not exceeding the permission number ARN. Therefore, the process proceeds to step S39, and third automatic restart is carried out according to the output of the restart signal ARS (forward-rotation signal RDS). If coin jamming is eliminated by the third backward rotation, the electric motor 148 continues forward rotation while the dispensing signal DPS is output. However, if coin jamming has not been eliminated, the hopper control circuit 342 outputs the overload signal ORS as described above; therefore, the process proceeds from step S7 to step S10, and the above described processes are executed. Then, the restart number becomes 4 in step S36 and therefore exceeds the permission number ARN, which is 3, in step S37. Therefore, the process proceeds from step S37 to step S38.

In step S38, the hopper control circuit 342 outputs the error signal ERS to the higher-level control circuit 344. Then, the process proceeds to step S48, the restart number is reset to zero. Then, the process returns to step S1.

The higher-level control circuit 344, which has received the error signal ERS, carries out a trouble process, for example, causes the coin hopper 100 to be in a stopped state. In the present first embodiment, output of the dispensing signal DPS is stopped.

In this case, the hopper control circuit 342 detects On-to-Off of the dispensing signal DPS in step S3, proceeds to step S5 and outputs the stop signal STS, and then returns to step S1. Thereafter, this loop is repeated until the dispensing signal DPS is output again from the higher-level control circuit 344. Since the switch circuit 334 continues opening the circuit by virtue of this stop signal STS, the electric motor 148, therefore, the rotating disk 106 is not rotated, and the coins C are not fed out.

In the present first embodiment, output of the overload signal ORS is permitted three times so as to subject the rotating disk 106 to specified-angle backward-rotation drive three times as a result. However, the permission number ARN of the number of backward rotations can be arbitrarily set and may be two, four, or more. However, according to experimental values, even when it is rotated backward four times or more, the probability of eliminating coin jamming is low, and the probability of coin jam elimination is lowered at one to two times; therefore, three times is the most preferred.

Moreover, it is preferred to execute steps S11 and S12 after step S10 to reset the restart number, which has been calculated in step S36, to zero. This is for enabling the rotating disk 106 to carry out backward rotation specified number of times, three times in the present first embodiment upon occurrence of next coin jamming since, when the coin sensor 308 detects the coin C after restart, the probability that coin jamming has been eliminated is high.

More specifically, in step S11, the presence/absence of the detection signal of the coin C from the coin sensor 308 is determined. If the detection signal is determined, the process proceeds to step S12. If the signal is not determined, the process skips step S12 and returns to step S1.

In step S12, the restart number calculated and stored in step S36 is reset to zero. Then, the process returns to step S1.

Figure 20:
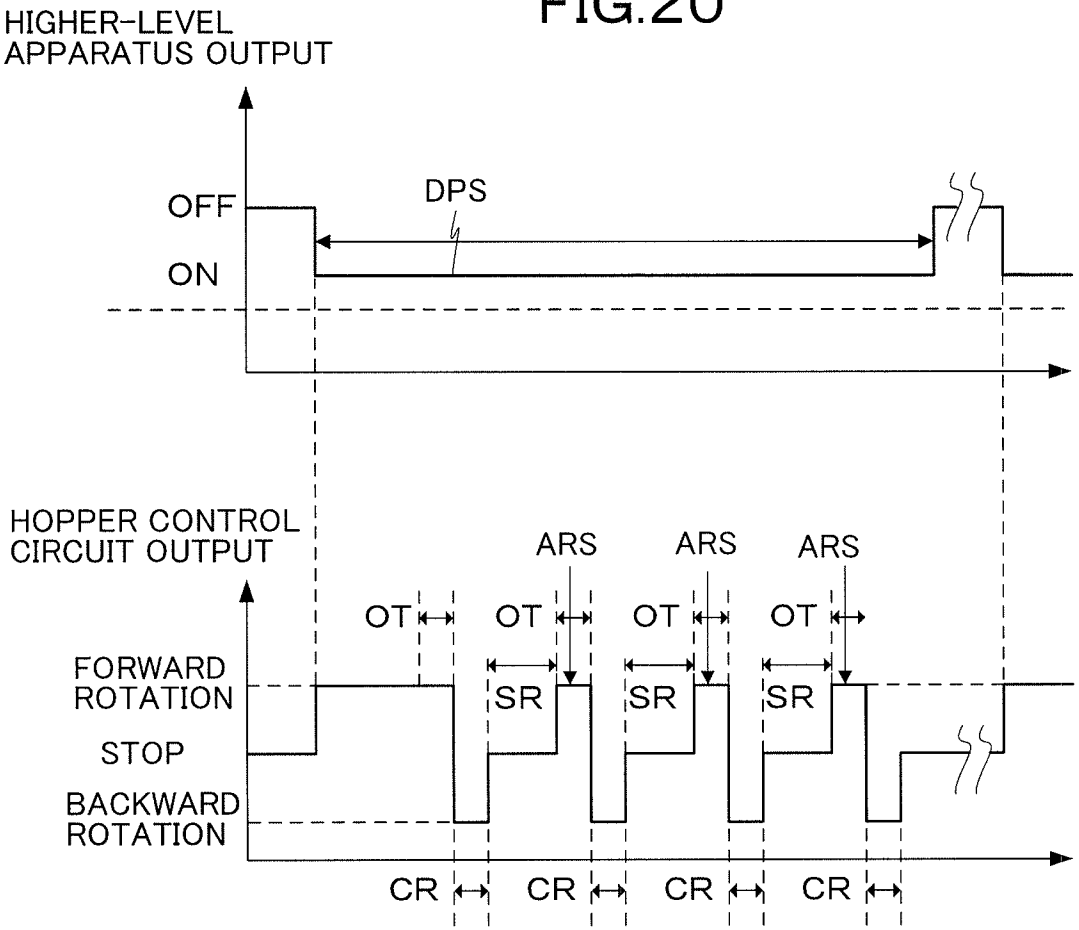
FIG. 20 is a control timing chart of the coin hopper of FIG. 1.

Next, also with reference to a timing chart of FIG. 20, working of the first embodiment will be explained based on the pusher 150A. "3" equal to the above description is assumed to be set as the permission number ARN of restart.

Normally, the higher-level control circuit 344 does not output the dispensing signal DPS. Therefore, the hopper control circuit 342 proceeds from step S1 to steps S3 and S5 and outputs the stop signal STS. The switch circuit 334 continues opening the circuit of the power feeding circuit 332 based on the stop signal STS, and the electric motor 148 is not rotated. Therefore, the rotating disk 106 is in a still state, and the coins C are not fed out.

When the higher-level control circuit 344 outputs the dispensing signal DPS, the hopper control circuit 342 proceeds to step S2 and outputs the forward-rotation signal RDS. Then, the process proceeds to step S4.

After it is determined in step S4 that the number ARC of restart is equal to or less than the permission number ARN "3", the forward-rotation signal RDS is determined in step S6. Therefore, the process proceeds to step S8, and whether the overload stop signal OSS is output or not is determined. If coin jamming has not occurred, the process proceeds to step S10, and the forward-rotation signal RDS is output. Then, the process returns to step S1.

Since the switch circuit 334 subjects the power feeding circuit 332 to forward rotation connection based on the forward-rotation signal RDS, the electric motor 148, therefore, the rotating disk 106 is rotated forward. This forward rotation causes the rotating disk 106 to rotate counterclockwise in FIG. 2 at a specified speed. As a result, the cam follower 256 is rotated and moved counterclockwise together with the rotation of the rotating disk 106 and is guided by the groove cam 264.

Therefore, when the cam follower 256 is positioned at the base part 272 of the groove cam 264, the pusher 150 is positioned at the standby position SP. Therefore, the surface of the coin C, which has dropped into the through hole 132, contacts the coin holding plate 156 and is held in the coin holding space 206. Also, other coins C are also held in the through holes 132 and overlapped on the coin C, which is held in the coin holding space 206, (the pushers 150A, 150B, and 150C in FIG. 4). When the rotating disk 106 is rotated, the force toward the circumferential direction caused by centrifugal force works on the coins C, and the lowermost coin C is moved to the circumferential-direction passage 192 in some cases. However, since the part excluding the outlet groove 151 is covered with the inner surface of the storage hole 146, the coin C is guided by the inner surface and is turned counterclockwise together with the sorting board 154.

As shown in FIG. 11, when the cam follower 256A is moved at the pushing connection part 276 of the groove cam 264, it gradually gets away from the rotating axis CE. Therefore, the pusher 150A is gradually turned counterclockwise while using the supporting shaft 242A as a pivot point.

The coin C held in the coin holding space 206 is moved to the circumferential-direction passage 192A side by the movement of the pusher 150A. At this position, the end surface of the circumferential-direction passage 192A is opposed to the end surface of the outlet groove 151. Therefore, the coin C can be moved to the outlet groove 151 over the circumferential edge of the sorting board 154.

As shown in FIG. 12, when the cam follower 256A reaches the tip part 274 of the groove cam 264, the cam follower is positioned in the vicinity of the position most distant from the rotating axis CE. Therefore, the pusher 150A is at the pushing position PP, at which the pusher has been turned counterclockwise the most while using the supporting shaft 242A as a pivot point as shown in FIG. 12. As a result, the coin C is at the position at which it has been moved the most in the circumferential direction with respect to the sorting board 154, and the center CC of the coin C is moved to a position outside of the circumferential edge of the sorting board 154. At this point, the coin C is moved while being held by the tip of the pusher 150A and the end of the front side guide 198A or held by the tip of the pusher 150A and the pusher 194A (FIG. 12). In the process the pusher 150A is positioned at the pushing position PP, the coin C starts being pushed to the left side in FIG. 13 by the pusher 194A and is pushed against the coin receiver 112.

Immediately after this, the pushing piece 314 starts pushing the coin C. Then, the coin C is pushed by the pushing piece 314, is moved along the coin receiver 112, and is fed out from the outlet 319 in the end.

The fed coins C are detected one by one by the coin sensor 308, and the coin detection signals CDS thereof are transmitted to the higher-level control circuit 344. If the coin detection signals CDS reach a sending set number in the higher-level control circuit 344, output of the dispensing signal DPS with respect to the hopper control circuit 342 is stopped, On-to-Off or Off continuance of the dispensing signal DPS is determined in step S3, the process proceeds to step S5, and the stop signal STS is output. Based on the stop signal STS, the switch circuit 334 opens the circuit of the power feeding circuit 332, and dispensing of the coins C is stopped.

In a case in which the rotating disk 106, therefore, the sorting board 154 is further rotated and the cam follower 256 positioned at the return connection part 278, the distance from the rotating axis CE is gradually shortened. Therefore, the pusher 150A is turned clockwise in FIG. 14 while using the supporting shaft 242A as a pivot point, in other words, turned toward the standby position SP.

Figure 15:
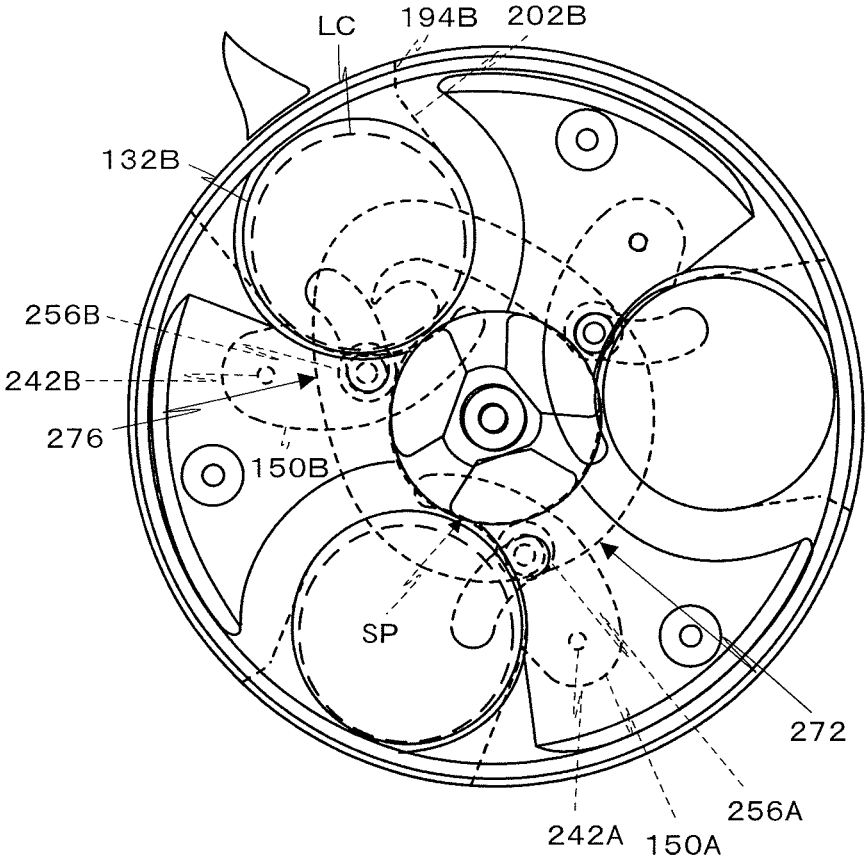
FIG. 15 is a working-explaining front view of the rotating disk used in the coin hopper of FIG. 1 (during backward rotation).
Figure 16:
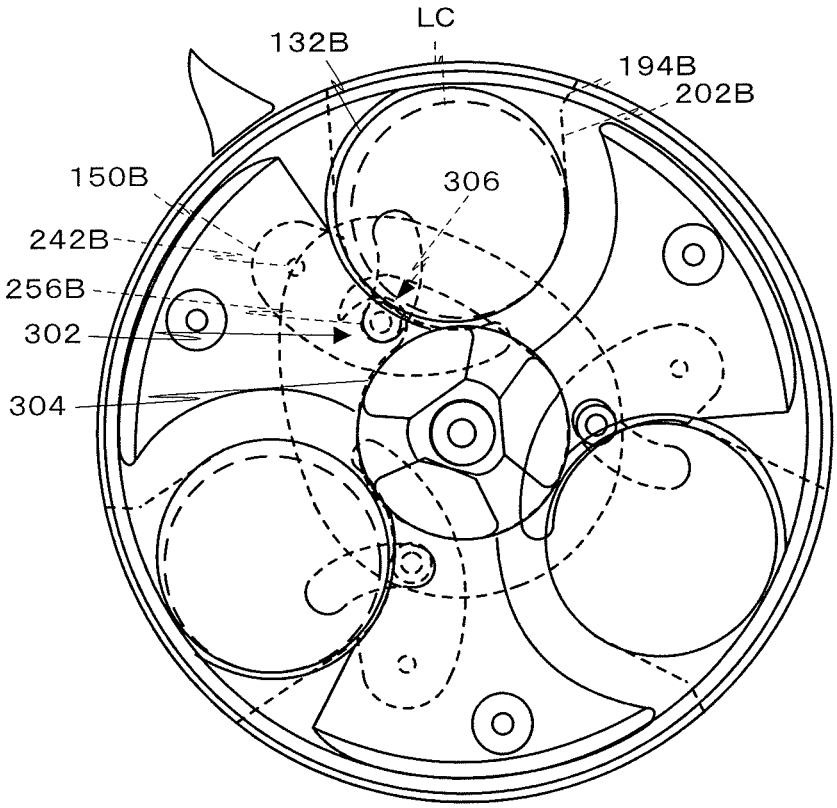
FIG. 16 is a working-explaining front view of the rotating disk used in the coin hopper of FIG. 1 (backward rotation finished).

For example, as shown in FIG. 15, when the cam follower 256A is positioned at the base part 272, as described above, the pusher 150A is held at the standby position SP.

In the dispensing process of the coins C, if coin jamming occurs and the overload detecting circuit 338 keeps outputting the specified overload signal ORS continuously and exceeds overload time OT as described above, the hopper control circuit 342 outputs the overload stop signal OSS in step S8; therefore, the switch circuit 334 opens the circuit of the power feeding circuit 332 in step S9, and the electric motor 148, therefore, the rotating disk 106 undergoes a transition to forward rotation by inertia. During this inertial forward rotation, the first measured time T1 is measured in step S15. Therefore, the first backward-rotation signal CRS1 is output in step S16, and the electric motor 148 is subjected to backward-rotation connection during the second measured time T2. Therefore, backward-rotation torque is applied, and the electric motor 148, therefore, the rotating disk 106 is rapidly stopped.

After the second measured time T2 elapses, the process proceeds to step S21, and the second stop signal STS2 is output. Therefore, during the third measured time T3 (steps S24, S25), the switch circuit 334 opens the circuit of the power feeding circuit 332, and, as a result, the rotating disk 106 stops still after inertial rotation.

After the third measured time T3 elapses, the second backward-rotation signal CRS2 is output in step S26. Therefore, the switch circuit 334 subjects the power feeding circuit 332 to backward-rotation connection. Therefore, the electric motor 148, therefore, the rotating disk 106 is rotated backward during the fourth measured time T4 (steps S29, S30). As a result of this backward rotation, at most, the rotating disk 106 is rotated backward until the cam follower 256 abuts the end 306 of the backward-rotation groove cam 306. Therefore, the coins C in the storing bowl 102 are stirred by the sorting board 154 to lose the balance among the coins and generate an opportunity to eliminate coin jamming. Therefore, coin jamming can be eliminated.

When the rotating disk 106 is rotated backward in a case in which the stop position of the cam follower 256 before the backward rotation is positioned at the return connection part 278 in FIG. 15, the cam follower 256 is moved clockwise along the backward-rotation internal edge 304, and the pusher 150A is therefore held at the standby position SP; therefore, the coin C held in the coin holding space 206 is prevented from being moved in the circumferential direction of the sorting board 154 and pushed against the circumferential surface of the storage hole 146. The amount of backward rotation is controlled by the fourth measured time T4. Therefore, when the fourth measured time T4 is appropriately set, even if there are variations in the amount of backward rotation, the output overload signal ORS output by the overload detecting circuit 338 does not exceed the specified time OT, and stop caused by overload of the electric motor 148 does not occur upon the backward rotation. By virtue of this backward rotation, the balance among the coins C is lost, and coin jamming is eliminated in many cases.

After the fourth measured time T4 is measured, the third stop signal STS3 is output in step S31. Therefore, the switch circuit 334 opens the circuit of the power feeding circuit 332 during the fifth measured time T5 (steps S34, S35). Therefore, if the electric motor 148, therefore, if the rotating disk 106 is stopped still after inertial rotation or if the cam follower 256 is stopped by the end 306, it continues being stopped still.

Thus, a coin jamming eliminating operation by the first backward rotation is completed.

Then, after the restart number is incremented by one in step S36, whether the number is within the permission number ARN of restart or not is determined in step S37. Since this time is the first time, the process proceeds to step S39 since the number is below the permission number 3, and the restart signal ARS is output. Then, the process returns to step S1.

While the dispensing signal DPS is output from the higher-level control circuit 344, the coin hopper 100 is automatically restarted by the restart signal ARS. More specifically, since the switch circuit 334 subjects the power feeding circuit 332 to forward-rotation connection based on the restart signal ARS, if coin jamming has been eliminated, the electric motor 148, therefore, the rotating disk 106 is rotated forward, and the coins C are dispensed one by one.

Moreover, the restart number stored in step S36 is reset to zero based on the coin detection signal CDS from the coin sensor 308 (steps S11, S12).

If the coin jamming has not been eliminated, the overload signal ORS is output again in step S8, the overload stop signal OSS is output since the specified overload time OT is exceeded, and a backward-rotation operation based on the first stop signal STS1, the first backward-rotation signal CRS1, the second stop signal STS2, the second backward-rotation signal CRS2, and the third stop signal STS3 is carried out in the above described manner. Then, the restart number is incremented by one and becomes 2 in step S36, is compared with the permission number 3 in step S37, and is below the permission number 3. Therefore, the restart signal ARS is output in the above described manner, and automatic restart is carried out. If the coin jamming has been eliminated by the second backward rotation, feeding of the coins C is continued in the above described manner. If the coin jamming has not been eliminated, the overload stop signal OSS is output in the above described manner.

A backward-rotation operation is carried out by the third overload signal ORS in a manner similar to the second time, and the restart number becomes 3 in step S36. However, since it is equal to or below the permission number ARN "3" (step S37), the restart signal ARS is output in step S39, automatic restart is carried out.

If the fourth overload stop signal OSS is output in step S8, a backward-rotation operation is carried out in the above described manner. However, the restart number becomes 4 in step S36, and it is determined in step 37 that the restart number is larger than the permission number ARN "3". As a result the process proceeds to step S38. Therefore, the restart signal ARS is not output, and a stopped state is obtained. More specifically, the error signal ERS is output in step S38, and the output of the dispensing signal DPS from the higher-level control circuit 344 to the hopper control circuit 342 is stopped. As a result, it is determined in step S3 that the dispensing signal DPS has been turned from on to off or has continued being off, the stop signal STS is output in step S5, and the switch circuit 334 opens the circuit of the power feeding circuit 332.

In the first embodiment, the backward-rotation amount (angle) of the rotating disk 106 is configured to be according to backward-rotation time CR (second measured time T2). However, the backward rotation may be carried out by detecting the rotation amount of the rotating shaft 189 by an encoder.

It has been experimentally found out that at least 30 degrees of backward rotation of the sorting board 154 is effective to elimination of coin jamming. In the present first embodiment, it is set so that backward rotation is carried out at least by 45 degrees.

Second Embodiment

Figure 21:
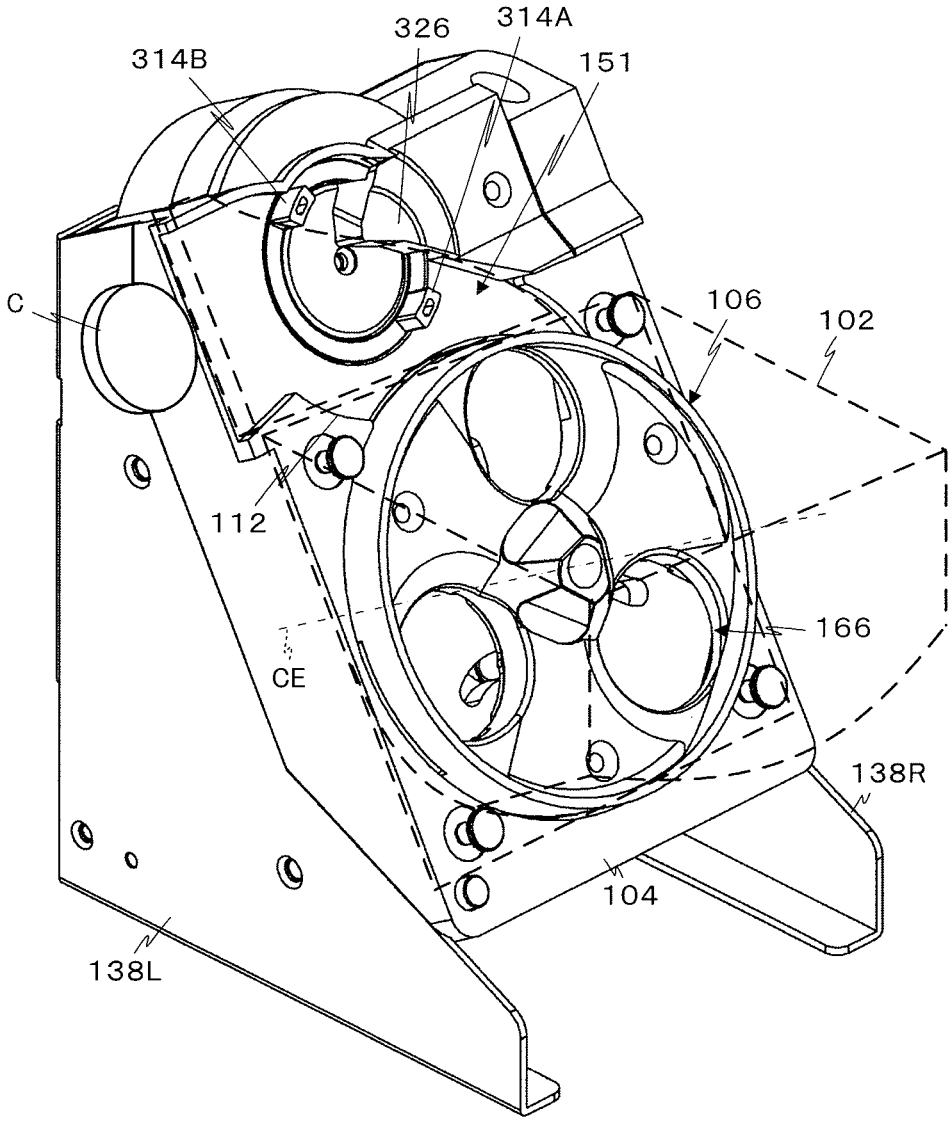
FIG. 21 is a perspective view of a coin hopper of a second embodiment of the present invention.

Next, a second embodiment will be explained with reference to FIG. 21.

In the second embodiment, the rotating axis CE of the rotating disk 106, therefore, the sorting board 154 is inclined with respect to the horizontal line. In other words, except that the rotating disk 106 is arranged to be upwardly inclined, the second embodiment has a configuration similar to that of the first embodiment. Therefore, unless otherwise explained, the same parts as those of the first embodiment are denoted by the same symbols, and explanations thereof are omitted.

In the second embodiment, the rotating axis CE are inclined upward by about 20 degrees with respect to the horizontal line, and the coins C in the storing bowl 102 are stacked to about a height of the rotating axis CE at most. In other words, about the lower half of the rotating disk 106 (sorting board 154) stirs the coins C, and the upper side thereof does not contact the coins C.

However, the same working and effects are exerted since the positional relations of the groove cam 264, the cam followers 256A, 256B, and 256C, the coin receiver 112, etc. are the same.

In the second embodiment, if the cam followers 256A, 256B, and 256C are positioned at the return connection part 278, a counterclockwise moment is generated at the pusher 150 by the weight of its own, centrifugal force is small since the backward-rotation time CR, therefore, the fourth measured time T4 is extremely short time, and it only abuts the backward-rotation internal edge 304 by the weight of its own. While the rotating disk 106 is continuously rotated, centrifugal force works on the cam followers 256A, 256B, and 256C and the pushers 150A, 150B, and 1500, and there is an inclination that the cam followers 256A, 256B, and 256C are guided along the external edge 266. Therefore, a biasing means for pushing the cam followers 256A, 256B, and 246C against the backward-rotation internal edge 304 is not required to be arranged in some cases.

Third Embodiment

Next, a third embodiment of the present invention will be explained with reference to FIG. 22.

Figure 22:
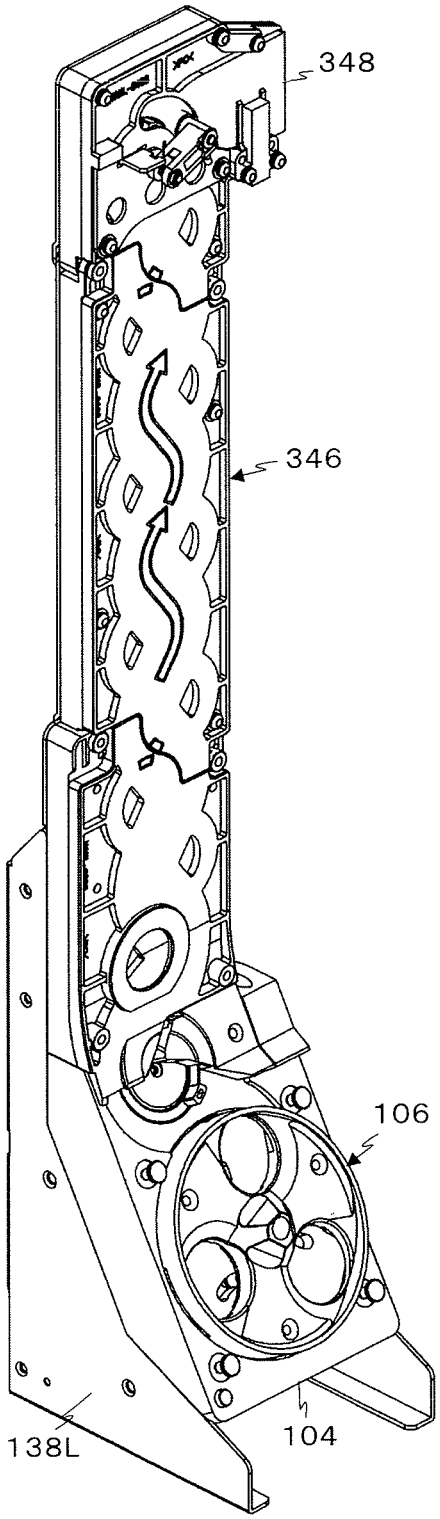
FIG. 22 is a perspective view of the coin hopper of a third embodiment of the present invention.

In FIG. 22, the parts same as those of the second embodiment are denoted with the same symbols, and explanations thereof are omitted.

In the third embodiment, the outlet of the coins C of the second embodiment is formed in an upward part, and a disk lifting apparatus 346 disclosed in Japanese Unexamined Patent Application Publication No. 2012-123712 is connected to the outlet so that the coins are fed out from an upward outlet 348 one by one.

What is claimed is:

1. A coin hopper comprising:

a storing chamber for storing coins in bulk and including a bottom hole;

a sorting board having a circular through hole, which is arranged in the bottom hole of the storing chamber, the sorting board being configured to cause the coins to drop from an upper side of the sorting board to a lower side of the sorting board through the through hole by rotation of the sorting board;

a pusher that pushes the coins one by one outward in an outer circumferential direction of the sorting board to a specified position at a back side of the sorting board;

a coin holding plate having a diameter that is approximately equal to a diameter of the sorting board, the coin holding plate being arranged to be concentric with and provided below the sorting board at a specified interval to define a coin holding space; and a circumferential-direction passage that is provided in the coin holding space at the back side of the sorting board, extends in a circumferential direction of the sorting board, and includes a front side guide positioned in a front position in a forward-rotation direction of the sorting board and a rear side guide positioned at a rear position thereof, wherein the pusher is movable at a specified timing upon forward rotation of the sorting board between a pushing position where the pusher is positioned in the coin holding space immediately below the through hole on the back side of the sorting board and a standby position where the pusher is positioned in a rotating axis side of the sorting board at a side of the through hole hidden below the sorting board, and when the pusher is gradually moved from the standby position to the pushing position, reaches the pushing position at a position corresponding to the specified position, and is gradually moved back to the standby position after reaching the pushing position, the coin is moved in the circumferential direction of the sorting board through the circumferential-direction passage from the through hole.

2. The coin hopper according to claim 1, wherein a coin receiver is fixedly arranged in an attachment base side at a position opposed to a circumferential edge side pusher formed in a circumferential edge side of the rear side guide in a lower side of a rib between the through holes and to a circumferential edge part of the sorting board, and at the pushing position, the coin is pushed into a part between the coin receiver and the circumferential edge side pusher by the pusher.

3. The coin hopper according to claim 1, wherein the sorting board is configured to be rotated backward, and along with the backward rotation, the pusher is configured to be moved backward with respect to the forward rotation, and in a zone in which the pusher is gradually moved from the pushing position to the standby position upon the forward rotation, the pusher is configured to be held at the standby position by a backward-rotation standby position holding cam.

4. A coin hopper comprising:

a storing chamber for storing coins in bulk and including a bottom hole;

a sorting board having a circular through hole, which is arranged in the bottom hole of the storing chamber, the sorting board being configured to cause the coins to drop from an upper side of the sorting board to a lower side of the sorting board through the through hole by rotation of the sorting board;

a pusher that pushes the coins one by one outward in an outer circumferential direction of the sorting board to a specified position at a back side of the sorting board;

a coin holding plate having a diameter that is approximately equal to a diameter of the sorting board, the coin holding plate being arranged to be concentric with and provided below the sorting board at a specified interval to define a coin holding space; and a circumferential-direction passage that is provided in the coin holding space the back side of the sorting board extends in a circumferential direction of the sorting board, and includes a front side guide positioned in a front position in a forward-rotation direction of the sorting board and a rear side guide positioned at a rear position thereof, wherein the pusher is arranged so as to be able to advance to and retreat from the coin holding space, a driving cam is arranged below the coin holding plate, the pusher is drivably coupled to the driving cam via a through hole provided in the coin holding plate, the pusher is movable at a specified timing upon forward rotation of the sorting board between a pushing position where the pusher is positioned in the coin holding space immediately below the through hole on the back side of the sorting board and a standby position where the pusher is positioned in a rotating axis side of the sorting board at a side of the through hole hidden below the sorting board, a circumferential edge side pusher is provided at a circumferential edge of the rear side guide, and a coin receiver is fixedly arranged in an attachment base side at a position opposed to a circumferential edge part of the sorting board, when the pusher is gradually moved from the standby position to the pushing position, reaches the pushing position at a position corresponding to the specified position, and is gradually moved back to the standby position after reaching the pushing position, the coin is moved in the circumferential direction of the sorting board through the circumferential-direction passage from the through hole, and at the pushing position, the coin is pushed into a part between the coin receiver and the circumferential edge side pusher by the pusher.

5. The coin hopper according to claim 4, wherein the sorting board is configured to be rotated backward and along with the backward rotation, the pusher is configured to be moved backward with respect to the forward rotation, and in a zone in which the pusher is gradually moved from the pushing position to the standby position upon the forward rotation, the pusher is configured to be held at the standby position by a backward-rotation standby-position holding cam.

6. The coin hopper according to claim 5, wherein the backward-rotation standby-position holding cam is a groove cam, and a cam follower integrated with the pusher is inserted in the groove cam.

7. The coin hopper according to claim 6, wherein the groove cam connects, by a gentle curve, a semicircular base part and a semicircular tip part smaller than the base part and has an egg shape comprised of a pushing connection part from the base part to the tip part and a return connection part from the tip part to the base part, a center of the base part aligns with a rotating axis of the sorting board, the tip part is arranged in the coin receiver side, and a backward-rotation groove cam that is connected to an intermediate part of the return connection part and holds the pusher practically immediately below the sorting board is provided.

8. The coin hopper according to claim 4, wherein a rotating-direction rear position side of the through hole on an upper surface of the sorting board is a slope, and a step is provided on a circumferential edge part thereof in a rotating-direction front position side.

9. A coin hopper comprising:

a storing chamber for storing coins in bulk and including a bottom hole;

a sorting board having a circular through hole, which is arranged in the bottom hole of the storing chamber, the sorting board being configured to cause the coins to drop from an upper side of the sorting board to a lower side of the sorting board through the through hole by rotation of the sorting board;

a pusher that pushes the coins one by one out in an outer circumferential direction of the sorting board to a specified position at a back side of the sorting board;

a coin holding plate having a diameter that is approximately equal to a diameter of the sorting board, the coin holding plate being arranged to be concentric with and provided below the sorting board at a specified interval to define a coin holding space; and a circumferential-direction passage that is provided in the coin holding space at the back side of the sorting board, extends in a circumferential direction of the sorting board, and includes a front side guide positioned in a front position in a forward-rotation direction of the sorting board and a rear side guide positioned at a rear position thereof, wherein the pusher is arranged so as to advance to and retreat from the coin holding space, a driving cam is arranged below the coin holding plate, the pusher is drivably coupled to the driving cam via a through hole formed in the coin holding plate, the pusher is movable at a specified timing upon forward rotation of the sorting board between a pushing position where the pusher is positioned in the coin holding space immediately below the through hole on the back side of the sorting board and a standby position where the pusher is positioned in a rotating axis side of the sorting board at a side of the through hole hidden below the sorting board, a circumferential edge side pusher is provided at a circumferential edge of the rear side guide, and a coin receiver is fixedly arranged in an attachment base side at a position opposed to a circumferential edge part of the sorting board, the pusher is configured to be gradually moved from the standby position to the pushing position, to reach the pushing position at a position corresponding to the specified position, and to be gradually moved back to the standby position after reaching the pushing position, at the pushing position, the coin is pushed into a part between the coin receiver and the circumferential edge side pusher by the pusher, the coin receiver defines an arc shape about a specified shaft center, a pushing piece that rotates about the axis is provided, and when the coin passes to the coin receiver by the pusher, the coin is moved along the coin receiver by the pushing piece.

10. The coin hopper according to claim 2, wherein the sorting board can be rotated backward, and along with the backward rotation, the pusher is configured to be moved backward with respect to the forward rotation, and in a zone in which the pusher is gradually moved from the pushing position to the standby position upon the forward rotation, the pusher is configured to be held at the standby position by a backward-rotation standby position holding cam.

* * * * *

UNITED STATES PATENT AND TRADEMARK OFFICE

CERTIFICATE OF CORRECTION

PATENT NO. : 9,105,140 B2
APPLICATION NO. : 14/100439
DATED : August 11, 2015
INVENTOR(S) : M. Enomoto It is certified that error appears in the above-identified patent and that said Letters Patent is hereby corrected as shown below:

In the Claims

Column 41, line 26 (claim 4, line 19) please change "space the" to -- space at the --
Column 41, line 32 (claim 4, line 25) please change "to be able to advance" to -- to advance --

Signed and Sealed this
Twenty-first Day of June, 2016

Michelle K. Lee

Michelle K. Lee
*Director of the United States Patent and Trademark Office*